US005774900A

United States Patent [19]

Wu et al.

[11] Patent Number: 5,774,900

[45] Date of Patent: Jul. 7, 1998

[54] INDUSTRIAL SAFETY HELMET

[75] Inventors: Shih-Hsiung Wu, Taipei; Chung-Yun Gau, Taipei Hsien; Yeh-Liang Hsu, Tao-Yuan-Hsien; Huoy-Shyi Tsay, Taipei, all of Taiwan

[73] Assignee: Institute of Occupational Safety and Health, Council of Labor Affairs, Taipei, Taiwan

[21] Appl. No.: 668,697

[22] Filed: Jun. 24, 1996

[51] Int. Cl.[6] ..... A42B 3/00

[52] U.S. Cl. ..... 2/411; 2/416; 2/171.3

[58] Field of Search ..... 2/410, 411, 416, 2/417, 418, 420, 421, 424, 425, 171.3

[56] References Cited

U.S. PATENT DOCUMENTS

| | | | |
|---|---|---|---|
| 3,205,508 | 9/1965 | Cox | 2/410 |
| 3,273,162 | 9/1966 | Andrews, III | 2/410 |
| 3,783,450 | 1/1974 | O'Connor | 2/421 |
| 3,925,821 | 12/1975 | Lewicki | 2/425 |
| 4,030,140 | 6/1977 | Burt | 2/410 |
| 4,404,690 | 9/1983 | Farquharson | 2/420 |
| 4,434,514 | 3/1984 | Sundahl et al. | 2/425 |
| 4,463,456 | 8/1984 | Hanson | 2/416 |
| 4,833,735 | 5/1989 | Long et al. | 2/419 |
| 4,944,361 | 7/1990 | Lindgren et al. | 2/423 |
| 5,083,321 | 1/1992 | Davidsson | 2/421 |
| 5,113,534 | 5/1992 | Lane et al. | 2/416 |
| 5,263,204 | 11/1993 | Butsch | 2/424 |
| 5,450,631 | 9/1995 | Egger | 2/425 |
| 5,517,691 | 5/1996 | Blake | 2/5 |

*Primary Examiner*—Michael A. Neas
*Attorney, Agent, or Firm*—Bacon & Thomas

[57] ABSTRACT

An industrial safety helmet comprises a shell of a semioval shape, a cradle, and a chin strap. The shell has one or more flexures capable of strengthening the shell and of promoting air circulation of the shell. The flexures are provided respectively at the front end thereof with an air inlet while at least one of the flexures is provided at the rear end thereof with an air outlet. The cradle has an energy-absorbing mechanism. The chin strap is provided with a detachable adhesive buckling mechanism.

7 Claims, 25 Drawing Sheets

INDUSTRIAL SAFETY HELMET

FIELD OF THE INVENTION

The present invention relates generally to an industrial safety helmet, and more particularly to an industrial safety helmet comprising a shell provided thereon with a ventilation flexure, a cradle having an energy-absorbing mechanism, and a chin strap having an adhesive buckling mechanism capable of being unfastened automatically so as to prevent the neck of a wearer of the helmet from being choked by the chin strap at such time when the helmet is hit by a falling object or impacted by a moving object, or when the wearer of the helmet trips accidentally.

BACKGROUND OF THE INVENTION

The industrial safety helmet is the most important and widely-used headpiece for protecting the head of a worker in the workshop, construction site or mine; it is primarily intended to protect a worker's head against the blow of a falling object, the direct impact of an object in motion, or the concussion brought about by an incident in which the worker trips.

The protective function of the industrial safety helmets is well appreciated by the workers at large. However, most workers feel that the conventional safety helmets are something of a nuisance, in view of the fact that the conventional industrial safety helmets are rather heavy and poorly-ventilated. As a result, the workers are often forced by the safety regulations to wear the safety helmet with a great deal or reluctance. In order to overcome the worker's phobia of the industrial safety helmet, some safety helmet makers have introduced the lightweight industrial safety helmet having a shell provided with ventilation holes. However, such an improved safety helmet as described above is ineffective at best, in view of the fact that the shell strength of the improved safety helmet is greatly compromised.

Moreover, the conventional industrial safety helmets are generally defective in design in that they are provided with a chin strap which is fastened by riveting, hinging or buckling and is therefore unable to unfasten automatically so as to prevent the choking of a wearer at such time when the safety helmet is impacted by a falling object to move aside in the direction toward the back of the wearer.

The conventional industrial safety helmets are further defective in design in that they comprise a cradle which is capable of a tensile deformation for absorbing the shock energy. Such an energy-absorbing mechanism of the cradle as referred to above is inadequate at best.

SUMMARY OF THE INVENTION

It is therefore the primary objective of the present invention to provides an industrial safety helmet with an improved shell having one or more ventilation flexures capable of promoting the air circulation in the helmet.

It is another objective of the present invention to provide an industrial safety helmet with an improved cradle capable of absorbing energy effectively.

It is still another objective of the present invention to provide an industrial safety helmet with an improved chin strap which is fastened by the adhesive buckling and can be therefore unfastened with ease and speed.

It is still another objective of the present invention to provide an industrial safety helmet which is composed of a shell having one or more ventilation flexures, a cradle provided with an excellent energy-absorbing mechanism, a chin strap which is fastened by the adhesive buckling, and a head strap.

In keeping with the principle of the present invention, the foregoing objectives of the present invention are attained by an industrial safety helmet having an improved shell which is light in weight and is provided with a ventilation flexure for improving the air circulation in the helmet and for reinforcing the structural strength of the helmet.

The industrial safety helmet of the present invention further has a chin strap which is fastened by the adhesive buckling and is capable of being unfastened easily and quickly by an external tensile force exerting thereon so as to prevent the chin strap from choking the neck of a wearer of the helmet at such time when the helmet is hit by a violent blow.

The industrial safety helmet of the present invention comprises a cradle which is provided with a folding fastened thereto by sewing. The cradle has an improved energy-absorbing effect, thanks to the folding which is bound to be destroyed when the pulling force exerting on the cradle has reached a predetermined value.

To be more specific, the industrial safety helmet of the present invention described above is composed of a hollow rigid shell of a substantially semioval shape. The shell is characterized in that it is provided at the top portion thereof with a primary folding flexure extending outwards and parallel to the longitudinal axis of the semioval shell. The primary folding flexure is provided respectively at a front end and a rear end thereof with an opening for allowing the atmospheric air current to flow through the primary folding flexure. In other words, the primary folding flexure is intended to promote the air circulation in the shell and to reinforce the structural strength of the shell.

It is preferable that the primary folding flexure of the shell of the present invention is further provided with a recess located in front of the front end opening of the primary folding flexure.

It is preferable that the primary folding flexure of the shell of the present invention is further provided respectively on both sides thereof with a secondary folding flexure parallel to the short axis of the semioval shell and extending outwardly. The secondary folding flexure has a ventilation port located at one end thereof contiguous to the shell rim.

Selectively, the primary folding flexure of the shell is further provided with a small folding flexure located in front of the front end opening of the primary folding flexure such that the small folding flexure is flush with the primary folding flexure, and that the small folding flexure is narrower than the primary folding flexure. The small folding flexure has a ventilation port located at one end thereof farther from the front end opening.

A cradle suitable for use in the industrial safety helmet of the present invention is composed of two or more suspension straps and a ring-shaped head strap. The suspension straps are respectively joined at two ends thereof with two opposite sides of the head strap such that the suspension straps intersect each other. As a result, the cradle is of a construction similar to a suspended basket. Each of the suspension straps has one end which is contiguous to the head strap and is joined with an inner portion of the shell which is adjacent to the shell rim. The suspension straps are provided respectively with a folding fastened therewith by sewing. The folding is destroyed at such time when the load exerting on both ends of the suspension straps has arrived at a predetermined value. The folding has an energy-absorbing effect.

Preferably, the cradle is further provided with an elastic pad which is located at the intersection of the suspension straps in such a manner that the elastic pad takes hold of the suspension straps.

Preferably, the rim of the shell of the present invention is further provided with a chin strap which is fastened at both ends thereof with the shell rim. The chin strap is provided between both ends thereof with an adhesive buckling and unbuckling mechanism. The shell rim is more appropriately provided with two fastening holes opposite in location to each other. The chin strap is provided respectively at both ends thereof with a hook engageable with any one of the two fastening holes of the shell rim.

DETAILED DESCRIPTION OF THE PREFERRED EMBODIMENTS

Figure 33:
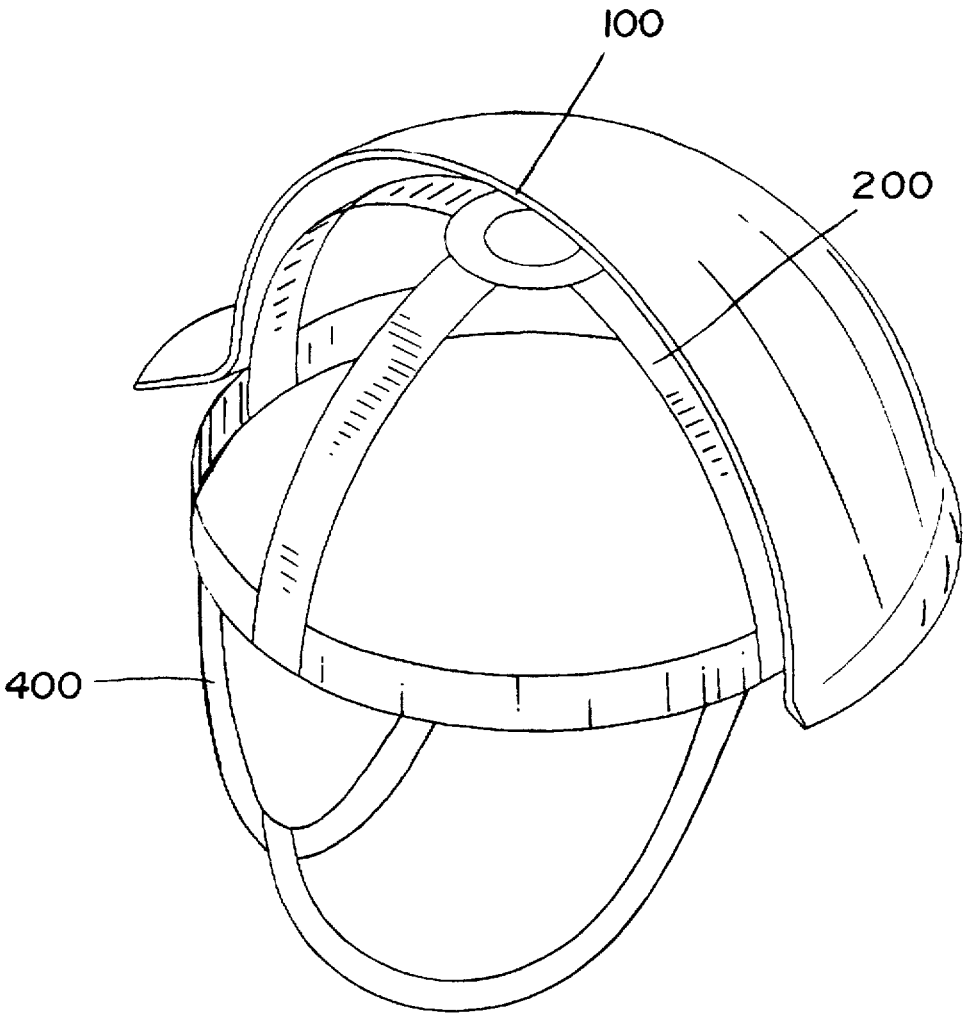
FIG. 33 (PRIOR ART)
FIG. 33 shows a schematic view of a conventional industrial safety helmet.

As shown in FIG. 33, the conventional industrial safety helmet comprises a shell 100, a cradle 200, and a chin strap 400. The shell 100 is incapable of dissipating heat effectively. The shell 100 may be provided with a plurality of ventilation holes which are proved to be ineffective in cooling the wearer's head by the experiment conducted by the inventor of the present invention. In addition, the ventilation holes referred to above undermine the structural strength of the safety helmet.

On the basis of the research which these inventors of the present invention have undertaken over a prolonged period of time, it is concluded that the ventilation effect of the safety helmet can be greatly enhanced by providing the helmet shell with a flexure similar in function to an air duct, without compromising the structural strength of the helmet shell. Moreover, the folding flexure can even strengthen and lighten the helmet shell.

Figure 35:
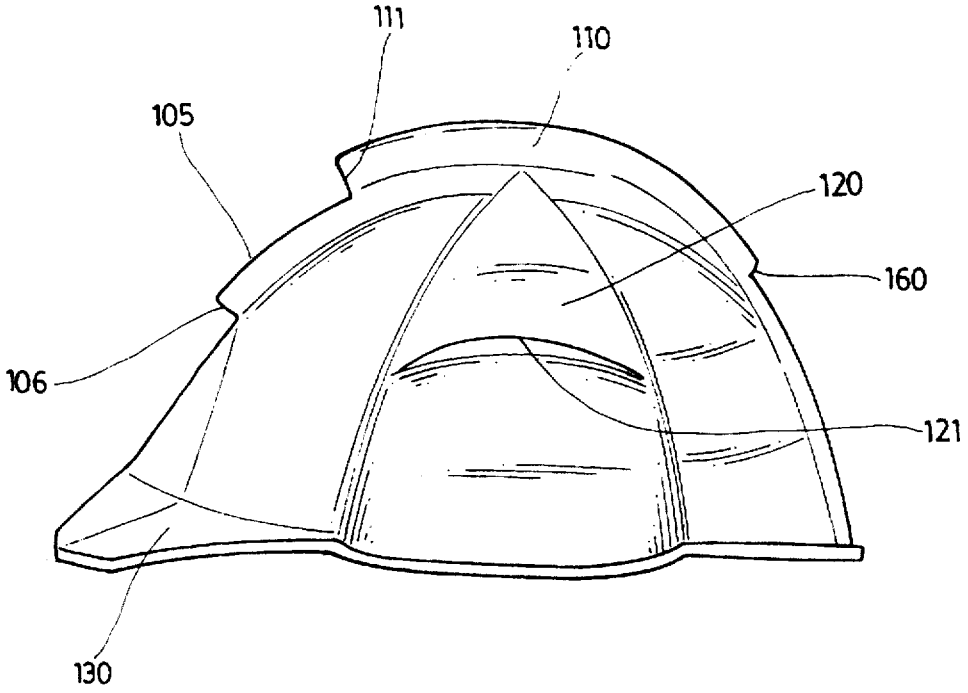
FIG. 35 shows a side view of a helmet shell of the first preferred embodiment of the present invention.
Figure 36:
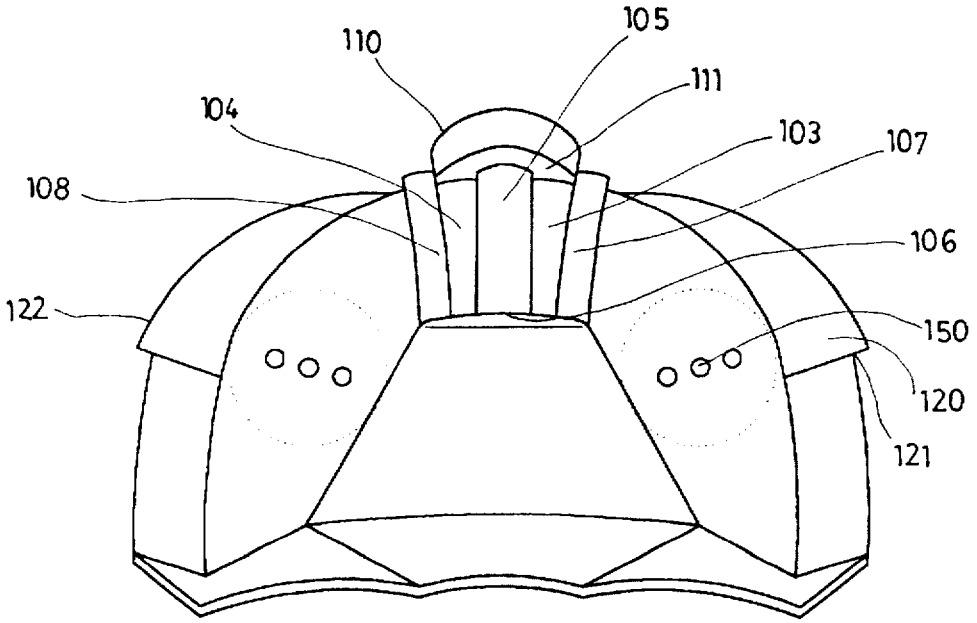
FIG. 36 shows a front view of the helmet shell of the first preferred embodiment of the present invention.
Figure 37:
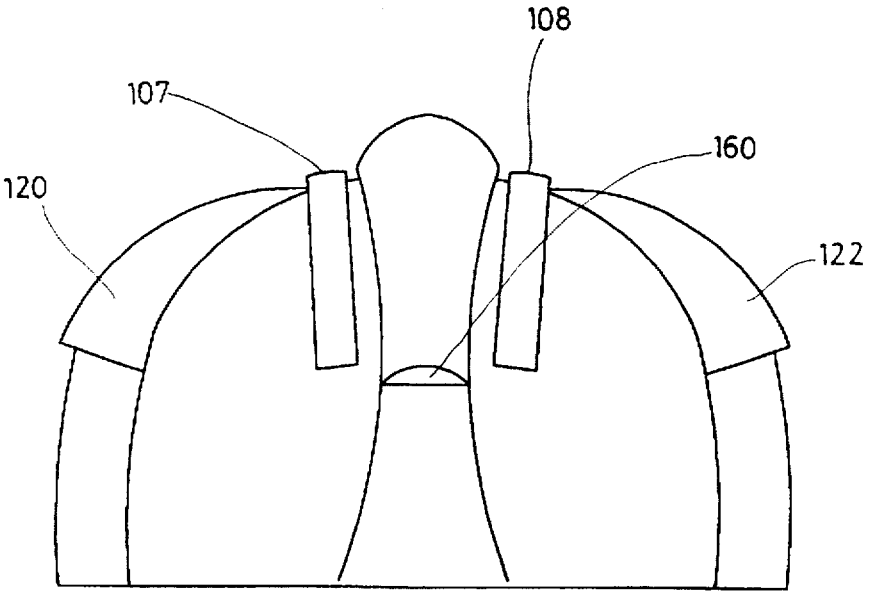
FIG. 37 shows a rear view of a helmet shell of the first preferred embodiment of the present invention.

An industrial safety helmet of the first preferred embodiment of the present invention is shown in FIGS. 35–37. The industrial safety helmet of the first preferred embodiment of the present invention is composed of a hollow rigid shell 100 of a semioval shape. The shell 100 has a length of 290 mm (including the length of 130 mm of peak), which is measured along the direction of the longitudinal axis of the shell 100. The shell 100 further has a length of 220 mm, which is measured along the direction of the short axis of the shell 100. In addition, the shell 100 has a height of 160 mm. The shell 100 is provided on the top thereof with a first flexure 110 extending outwards and parallel to the longitudinal axis of the shell 100. The first flexure 110 is provided at the front end thereof with an air inlet 111 having a width of 60 mm. The air inlet 111 is located such that it remains apart from the peak 130 by a vertical distance of 145 mm. The first flexure 111 is further provided at the rear end thereof with a rear ventilation port 160 which is kept apart from the rim by a vertical distance of 92 mm. The shell 100 is provided with two recesses 103 and 104 which are separated and located in front of the air inlet 111. Located between two recesses 103 and 104 is a second flexure 105 extending outwards and in the same direction as the first flexure 110. The second flexure 105 is narrower than the first flexure 110 and is provided at the front end thereof with an auxiliary air inlet 106 which is about 30 mm in width and is kept apart from the peak 130 by a height of about 90 mm. The shell 100 is further provided with two small flexures 107 and 108 accompanying the two recesses 103 and 104 and two sides of a portion of the first flexure 110. These two small flexures 107 and 108 extend outwards to reinforce the structural strength of the shell 100. The shell 100 is further provided with a third flexure 120 and a fourth flexure 122, which are located by both sides of the first flexure 110 in such a manner that the third and the fourth flexures 120 and 122 are parallel to the short axis of the shell 100, and that the third and the fourth flexures 120 and 122 are separated in a form of mirror image by a plane dividing vertically the shell 100 into two equal parts along the direction of the longitudinal axis of the shell 100. Both the third and fourth flexures 120 and 122 have a dimension which is gradually smaller toward the upper end thereof. Located at one end near the rim is a side ventilation port 121 having a width of 86 mm or so and a height of 60 mm or so apart from the rim. The front ventilation holes 150 circled by the dotted line in FIG. 36 is specially designed for the heat dissipation experiment which is described hereinafter. For this reason, it must be noted here that the industrial safety helmet of the present invention is not necessarily provided with the front ventilation holes 150.

Figure 34:
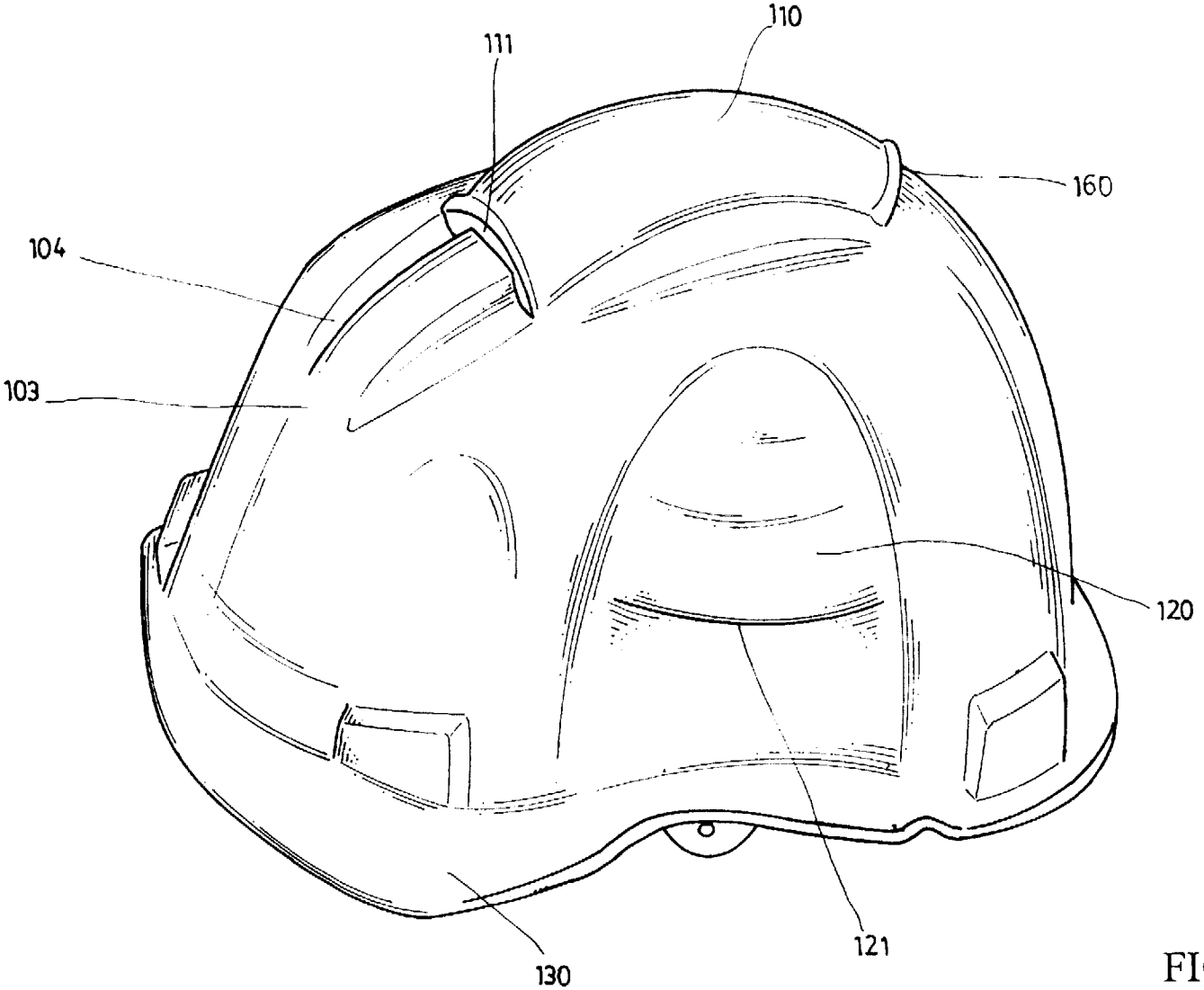
FIG. 34 shows a schematic view of a helmet shell of the second preferred embodiment of the present invention.

As shown in FIG. 34, an industrial safety helmet of the second preferred embodiment of the present invention has a shell which is similar in shape and size to that of the industrial safety helmet of the first preferred embodiment of the present invention, except that the shell of the former is devoid of the second flexure 105. The reference numerals of FIG. 34 are similar in definition to those of FIGS. 35–37. The arrows shown in FIG. 34 are intended to indicate the imaginary direction in which the air current flows.

Figure 40:
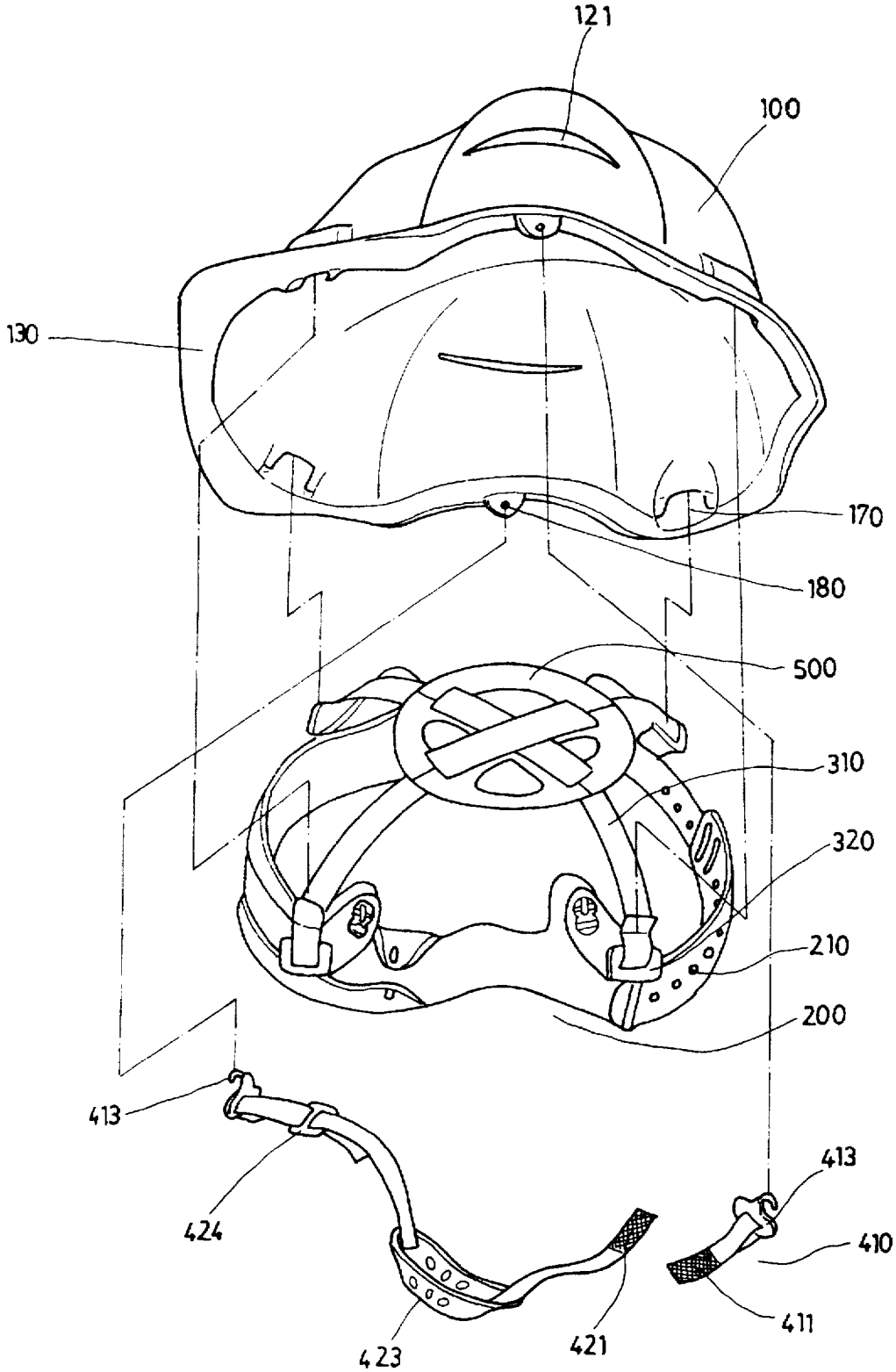
FIG. 40 shows an exploded view of the second preferred embodiment of the present invention.

As shown in FIG. 40, a shell 100 of the industrial safety helmet of the second preferred embodiment of the present invention is provided with a cradle 200 and a chin strap 400. The cradle 200 comprises two suspension straps 310 intersecting each other, and a ring-shaped head strap 210. The suspension straps 310 are provided respectively at both ends thereof with an insertion element 320 which is plugged into a receiving slot 170 contiguous to the rim of the inner portion of the shell 100. Located at the intersection of two suspension straps 310 is an elastic pad 500, which takes hold of the suspension straps 310. The rim of the shell 100 is provided with two lugs opposite in location to each other. The lugs are provided respectively with a fastening hole 180. The chin strap 400 is composed of two woven straps 410 and 420, which are provided respectively at one end thereof with a hook 413 engageable with the fastening hole 180 for fastening the end of the chin strap 400 with the rim of the shell 100. These two woven straps 410 and 420 are further provided respectively at another end thereof with a male (ℓ) structure 411 and a female (Ω) structure 421 of an adhesive buckling mechanism. As a result, the woven straps 410 and 420 can be detachably fastened together. The woven strap 420 is further composed of a lower chin fastening piece 423 and a length adjusting piece 424.

Figure 41:
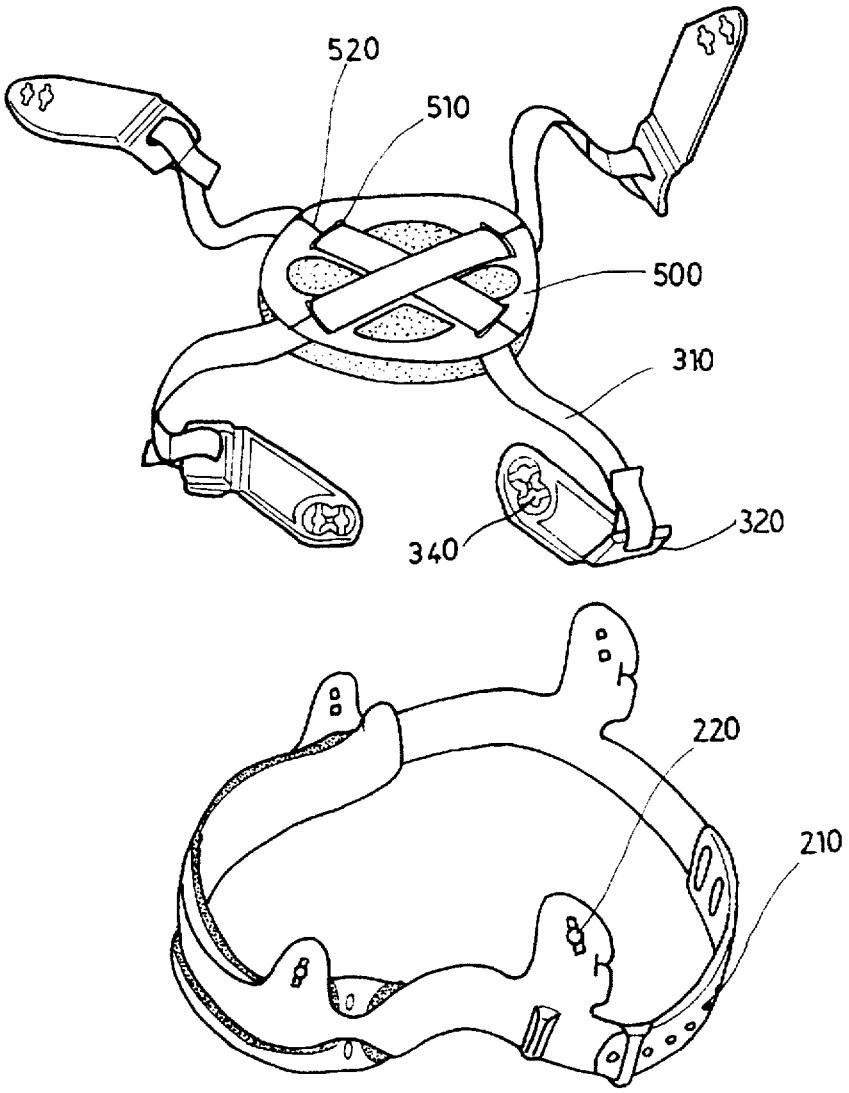
FIG. 41 shows a schematic view of the cradle 200 as shown in FIG. 40.

As shown in FIG. 41, the insertion element 320 of the suspension strap 310 is provided at the lower end thereof with a connection piece made integrally therewith. The connection piece is provided with a connection mortise 340. The head strap 210 is provided respectively at four appropriate positions thereof with a connection tenon 220 engageable with the connection mortise 340. The elastic pad 500 is provided with a through hole 510, and a slit 520 from which the suspension strap 310 can be so inserted as to be located securely in the through hole 510.

Figure 42A:
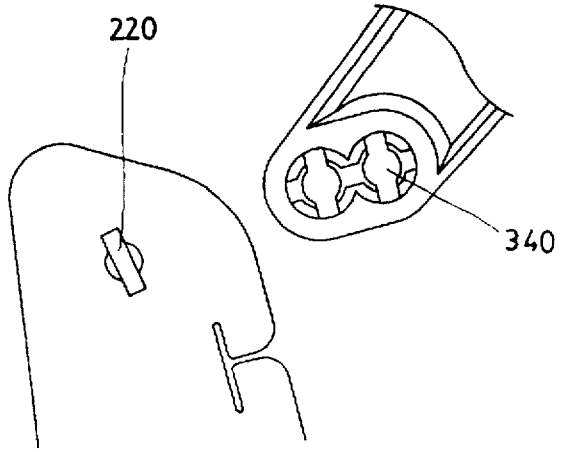
FIGS. 42A, 42B and 42C are schematic views showing the steps of joining the suspension strap 310 with the head strap 210 of FIGS. 40 and 41.
Figure 42B:
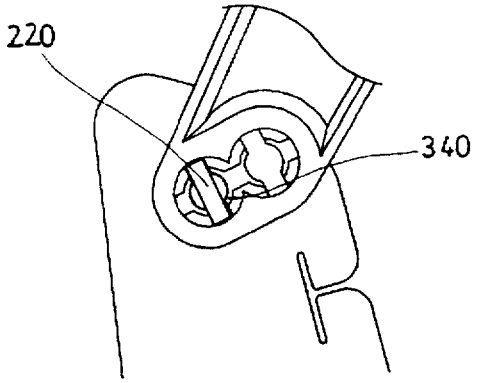
Figure 42C:
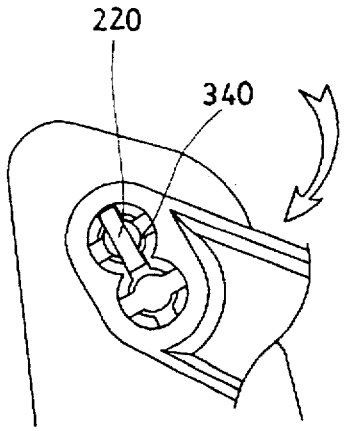

The steps of fastening the connection tenon 220 with the connection mortise 340 are illustrated in FIGS. 42A–42C. As shown in FIG. 42A, the long hole of the connection mortise 340 of the suspension strap 310 is first aligned with the connection tenon 220 of the head strap 210 before the connection tenon 220 is engaged with the connection mortise 340, as shown in FIG. 42B. Thereafter, the connection tenon 220 is rotated for an angle of 90 degrees so as to cause the short hole of the connection mortise 340 to located under the connection tenon 220, as shown in FIG. 42C. As a result, the suspension strap 310 is joined with the head strap 210, as illustrated in FIG. 40.

The helmet shell described above is similar in profile to the conventional industrial safety helmet such that the periphery of the helmet shell may be provided with a rim or a peak only. The helmet shell of the present invention is made of a smooth rigid material which is similar in nature to that of the conventional industrial safety helmet. The helmet shell of the present invention is further similar in the production molding method to the shell of the conventional industrial safety helmet. The helmet shell of the present invention is different from the shell of the conventional industrial safety helmet in that the former is provided with one or more flexures similar in function to the air duct. For example, the shell of the present invention is provided on the top thereof with a flexure extending in the direction of the longitudinal axis of the shell. The shell of the present invention may be provided with one or more flexures contiguous to the top of the shell. The flexures may be also located on both sides of the shell such that the flexures extend from the lower portion of the shell toward the upper portion of the shell. In general, it is recommended that the shell is provided on the top thereof with a flexure extending in the direction of the longitudinal axis of the shell. More preferably, the shell is provided with a flexure extending on the top of the shell along the direction of the longitudinal axis of the shell, and with one flexure located on each of both sides of the shell such that the flexure extends from the lower portion of the shell toward the upper portion of the shell. The flexure of the present invention is similar in function to an air duct and is formed by the projected and the recessed portions. The flexure has two ends which are provided respectively with an opening serving as an air inlet or air outlet. If necessary, the flexure may be provided at or near the opening with a grooved portion or a protruded portion in conjunction with the projected flexure or the recessed flexure for enhancing the flow of air current in the flexure. It is suggested that the shell of the present invention is preferably provided with a projected flexure in conjunction with a grooved portion.

The flexure also serves to strengthen and lighten the shell of the present invention. The ventilation effect of the shell of the present invention can be further improved by providing the shell with the ventilation holes and an arcuate peak. Moreover, the effect of cooling the inside of the shell can be attained partially by a light reflecting paper which is adhered to the top surface of the shell of the present invention. It is well known in the art that the structure of flexure is capable of giving an object an added strength in construction. However, the flexure has never been applied to the industrial safety helmet for enhancing the ventilation effect of the industrial safety helmet.

The cradle of the present invention is similar in construction to the prior art cradle, such as the cradle sold by E. D. Bullard Co., Cynthiana, N.Y., U.S.A. The cradle is preferably provided with a folding fastened therewith by sewing.

Figure 39:
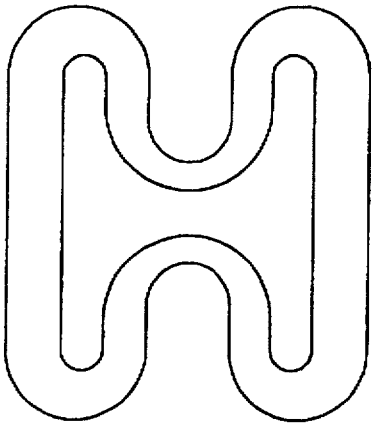
FIG. 39 shows a schematic view of a deformable energy-absorbing piece suitable for use in the present invention.

The method for fastening the cradle of the present invention with the shell is similar to the prior art method used by E. D. Bullard Co. referred to above. It is preferable that the cradle is fastened with the shell by means of a damper or deformable energy-absorbing piece serving as an energy-absorbing mechanism. The damper may be a rubber pad. The deformable energy-absorbing piece may be a deformable energy-absorbing piece, as shown in FIG. 39.

The chin strap of the present invention is similar in construction to the prior art chin strap. The chin strap of the present invention is fastened with the shell by any conventional method. However, it is suggested that the chin strap is fastened with the shell by the hooking method, as shown in FIG. 40, in view of the fact that the chin strap can be disengaged easily with the fastening holes of the lugs of the shell at such time when the chin strap is exerted on by a greater pulling force. It is suggested that the hooking method should be able to withstand the impulse ranging between 1.2 kg·m/sec and 1.5 kg·m/sec.

The adhesive buckling mechanism of the chin strap of the present invention is similar in construction to any conventional adhesive buckling mechanism. The adhesive buckling area is preferably in the range of 3–10 $cm^2$, and more preferably in the range of 4–8 $cm^2$.

EXPERIMENT 1

According to the research conducted by these inventors of the present invention for a prolonged period of time, the main heat source of the heat dissipation problem of a safety helmet is derived from the combination of the solar heat, the human body heat and the environmental heat. This heat dissipation experiment was conducted to study the heat dissipation of the industrial safety helmet in the form of simulation.

1. The safety helmet was provided therein with thermal couples and connected with a temperature data collecting device for taking the test point temperature.

2. The halogen lamp was used in place of the sun as the heat source.

3. The electric heater was used to simulate the environmental temperature.

4. The fan was used to create the air convection current.

5. A dummy head was used in place of the human head and provided with an appropriate temperature corresponding to the human body temperature.

6. A temperature controller was used to turn the halogen lamp and the electric heater on and off so as to attain the constant environmental temperature.

7. An air conditioner was used to regulate the temperature and the humidity of the experimental environment.

Figure 1:
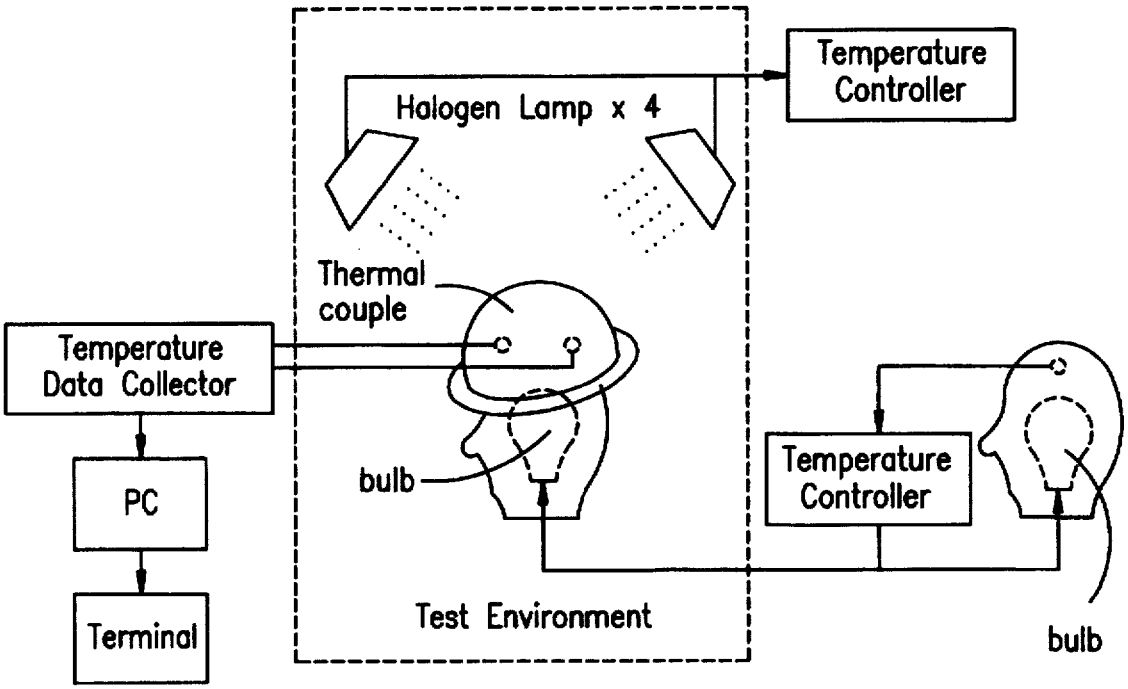
FIG. 1 shows a schematic view of the layout of an experiment in heat dissipation.

As illustrated in FIG. 1, the thermal couples were used to measure the temperatures inside the shell. The temperature signals were then sent to the data collector which was in communication with a computer. The temperatures of various points inside the shell were displayed on a terminal. The sensor of the temperature control was arranged on another dummy head for preventing the influence of the high temperature of the halogen lamp to hinder the normal operation of the temperature controller.

Figure 2:
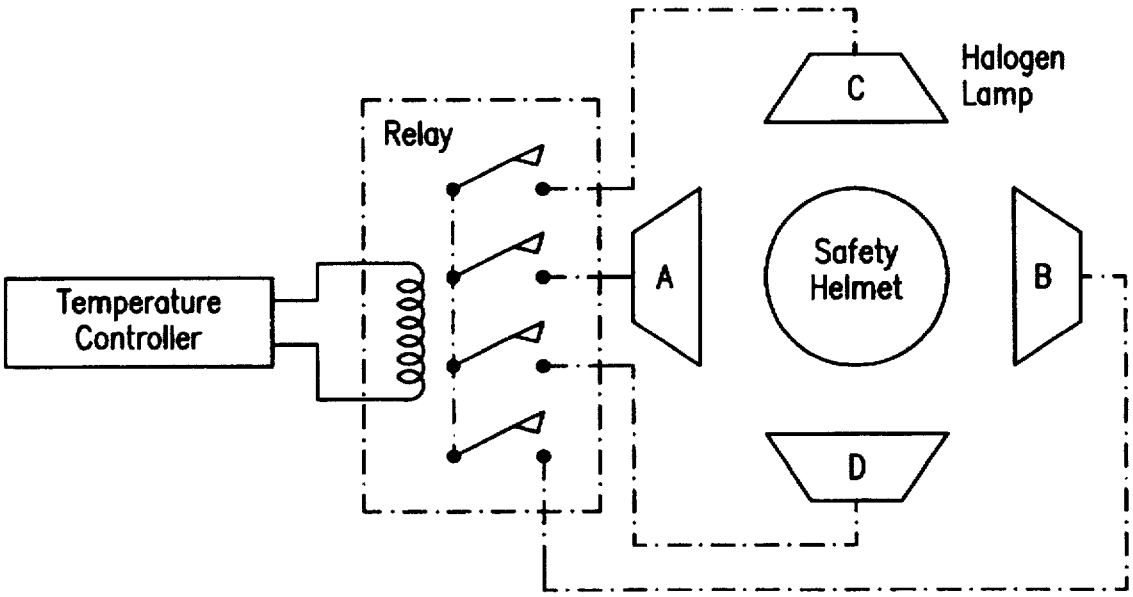
FIG. 2 shows a schematic view of an environment temperature control equipment of the heat dissipation experiment.

The main heat source of the experiment was derived from four halogen lamps. If the operation of the halogen lamps was controlled by a plurality of temperature controllers, the operation timing would be inconsistent to bring about the uneven distribution of the environmental temperatures attained in the test. On the other hand, the maximum load allowed by the temperature controller was limited to unable four halogen lamps to be connected simultaneously with a temperature controller. In order to prevent the halogen lamps from being unable to operate simultaneously to result in the inconsistency in temperature, this experiment made use of one temperature controller to control the relay capable of bearing the large current, so as to enable four halogen lamps to operate and to be turned on and off at the same time, as shown in FIG. 2.

This experiment was aimed at the conventional industrial safety helmet and the industrial safety helmet of the present invention. A series of tests were carried out to study the heat dissipation on the basis of the average temperature of the test points, the analysis of the cooling rates and the isothermal distribution. The analysis of the cooling rates was proved to be helpful in understanding the influence of the solar radiation on the temperature of the safety helmet. A faster cooling rate is capable of causing the temperature of the helmet to drop in a short period of time to an equilibrium temperature at which the wearing comfort is felt by the helmet wearer. The shell design can be based on the data of the isothermal distribution, through which the temperature distribution inside the shell is better understood. The number of the thermal couples of the test points of this experiment was large enough to cover a greater area so as to increase the reliability of the data so obtained.

This heat dissipation experiment was carried out to simulate the conditions under which the workers wear the industrial safety helmet. The dummy head in place of the human head was provided with an appropriate temperature to simulate the actual human body condition. The electric heater was used to simulate the summer heat while the halogen lamps were used to simulate the solar radiation. In this experiment, every effort was made to create the test environment conforming to the actual environment. Moreover, the temperature and the humidity of the test environment were strictly regulated so as to make this experiment as credible as possible.

1. The test environment and the fan were provided therebetween with an electric heater for regulating the temperature of the test environment to remain at 30±0.5° C., so as to prevent an adverse impact of the room temperature on the test environment.

2. When the test was under way, the wind direction was changed as required. The wind velocity was kept at 1.1 m/s and 2.5 m/s.

3. The dummy heat was kept at 37.6° C.

4. No one helmet was tested continuously. Further test was done only after the helmet under test was cooled to an appropriate temperature, so as to prevent the experimental data from being distorted by the heat stored by the shell.

5. Each test lasted for 15 minutes. The test duration was determined by the time that was required to attain the steady state through the experimental observation.

6. The statistical standard deviation of the experiment was 0.384° C., with the Gaussian distribution of errors being that 68.3% of the temperature test remain within $\pm\sigma$(0.384° C.), and than 95.4% of the temperature test remain at $\pm 2\sigma$(0.768° C.), and further that 99.7% of the temperature test remain at $\pm 3\sigma$(1.152° C.).

Figure 3:
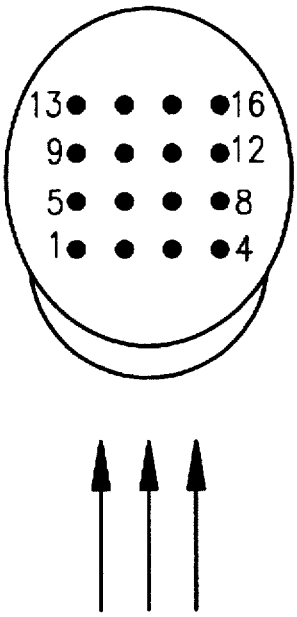
FIG. 3 shows a schematic view of the layout of thermal couples in the helmet shell according to the heat dissipation experiment

The thermal couples were suspended in the interior of the shell such that the thermal couples were not attached intimately to the surface of the shell interior so as to prevent the thermal couples from being affected directly by the temperature of the shell. In order to obtain the experimental data with precision, 16 thermal couples were arranged at an interval of 5 cm, as shown in FIG. 3.

As shown in FIGS. 35–37, the sample 1 of the industrial safety helmet of the present invention was provided with a rear ventilation port 160 which was sealed off. The experiment was conducted with the sample 1 of the present invention in conjunction with the control samples 1 and 2 of the conventional industrial safety helmet.

Figure 4:
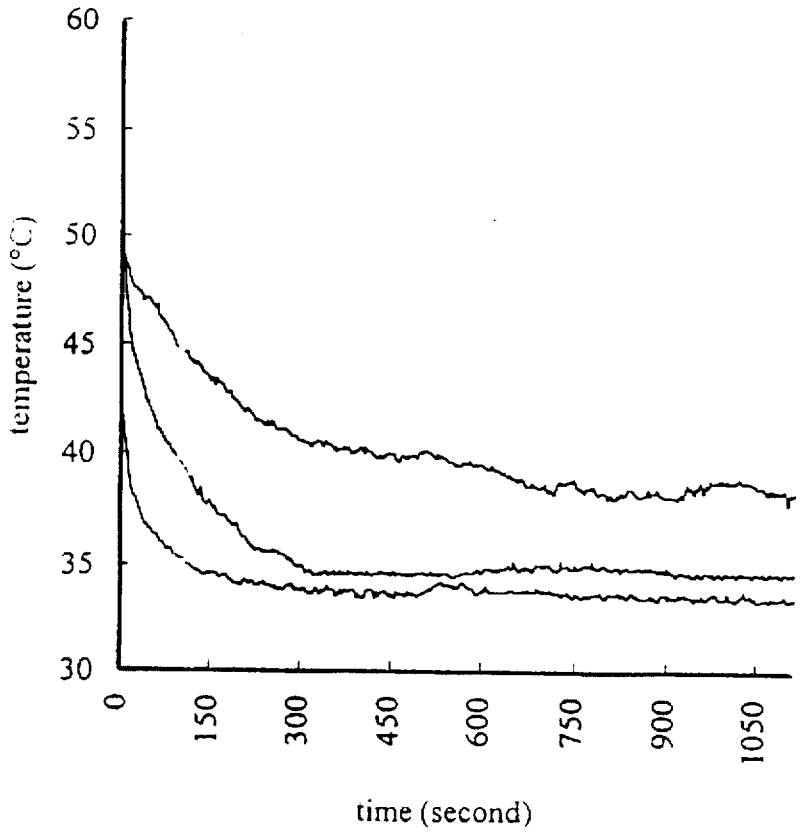
FIG. 4 is a diagram comparing the cooling rates of the conventional industrial safety helmets and the industrial safety helmet of a first preferred embodiment of the present invention. The upper curve is the cooling rate curve of the conventional industrial safety helmet sample 1 while the intermediate curve is the cooling rate curve of the conventional industrial safety helmet sample 2. The lower curve is the cooling rate curve of the sample 1 of the industrial safety helmet of the present invention.

In order to secure the cooling rate curve, the safety helmets to be tested are kept in the test environment devoid of wind before the halogen lamps and the electric heater were turned on to provide the test environment with the heat source. The shells were heated until an equilibrium temperature was attained. The temperature was reduced by the wind having a velocity of 2.5 m/s while the original heat source was maintained. The data were recorded in a computer. The comparison of the cooling rates is shown in FIG. 4.

The initial and the final equilibrium temperatures of the safety helmets of various types are presented in Table 1. The control sample 2 is shown to have the highest initial equilibrium temperature while the control sample 1 of the conventional safety helmet is shown to have the second highest initial equilibrium temperature. The control sample 1 of the conventional safety helmet is shown to have the highest final equilibrium temperature while the sample 1 of the present invention and the control sample 2 of the conventional safety helmet show little difference in the final equilibrium temperature.

TABLE 1

Experimental Data of Cooling Rates

| | initial equilibrium temperature, °C. | final equilibrium temperature, °C. | time (sec)* |
|---|---|---|---|
| sample 1 | 43.3 | 33.9 | 220 |
| control 1 | 50.1 | 38.3 | 700 |
| control 2 | 52.6 | 34.6 | 380 |

*The indicated time is the time that is required for the sample to arrive at the equilibrium temperature.

FIG. 4 shows the cooling rates of three safety helmets. The upper curve represents the cooling rate of the control sample 1 while the intermediate curve represents the cooling rate of the control sample 2. The lower curve represents the cooling rate of the sample 1 of the present invention. On the basis of Table 1 and FIG. 4, it is readily apparent that the sample 1 of the present invention is faster in the cooling rate than the control samples of the conventional safety helmets and is also faster in arriving at the equilibrium temperature than the control samples of the conventional safety helmets. In other words, upon being exposed to the sun, the safety helmet of the present invention is capable of cooling at a faster rate to arrive at the equilibrium temperature as compared with the safety helmets of the prior art. Needless to say, it is more comfortable to wear the safety helmet of the present invention.

Isothermal Distribution Analysis between the Sample 1 Helmet and the Control Sample 2 Helmet It is suggested that the design of the helmet shell should be based on the data of the isothermal distributions, which can be obtained by making use of the MATLAB software in conjunction with taking the x—y coordinates of the thermal couples from a top view of the helmet shell and taking the z-coordinate from the temperatures of the thermal couples.

Figure 5:
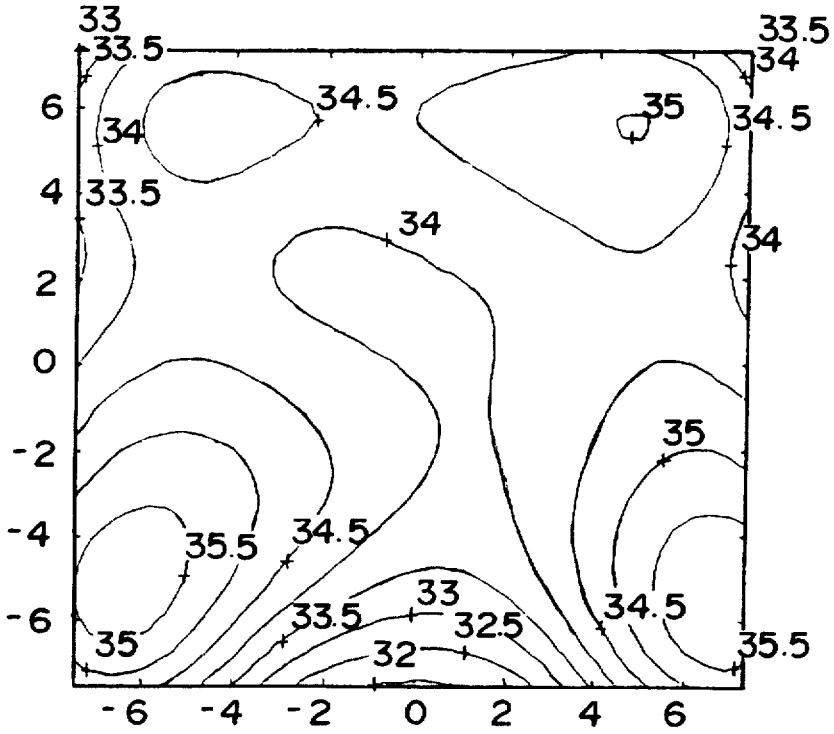
FIGS. 5 and 6 are isothermal distribution diagrams of the conventional industrial safety helmet sample 2 and the sample 1 of the industrial safety helmet of the present invention, with the rear ventilation port 160 of the shell of the sample 1 of the present invention being sealed off.
Figure 6:
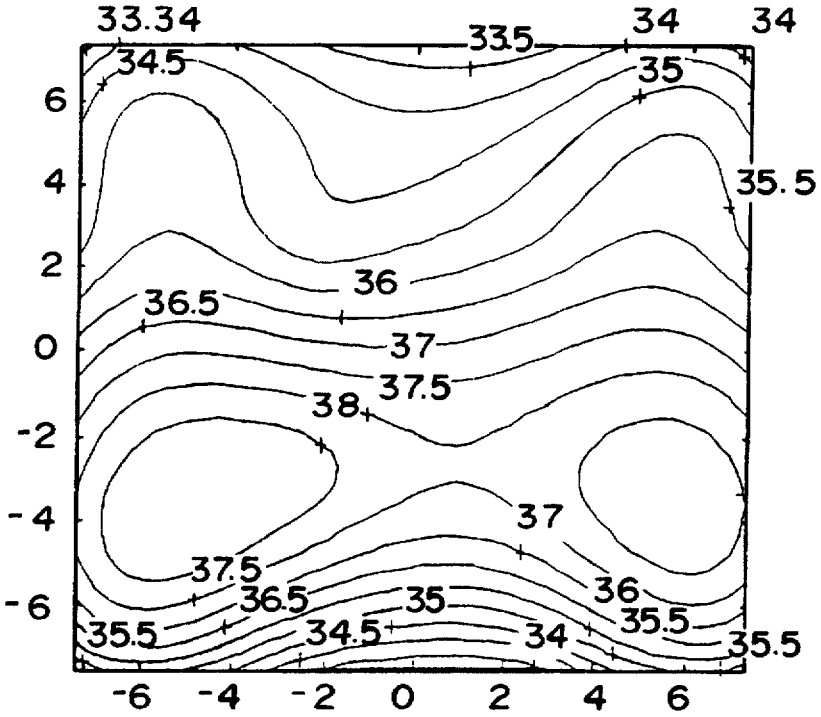

As shown in FIGS. 5 and 6, the sample 1 is relatively lower in the average temperature than the control 2. The distribution of the lower temperature is confined to not only the ventilated portions but also the entire shell body of the sample 1 of the present invention. It is therefore readily apparent that the flexures and the ventilation ports of the shell of the present invention are helpful in lowering the temperature inside the shell. As compared with the control 2, the sample 1 of the present invention has fewer isothermal lines to indicate that the temperature distribution of the sample 1 of the present invention is relatively uniform. The sample 1 of the present invention and the control 2 of the prior art have one thing in common in that both have a hot point located at the front end thereof. However, the hot point of the sample 1 is lower in temperature than the hot point of the control 2. In addition, the control 2 helmet shell has low temperature (34° C.) areas which are confined to front and the rear ends of the shell. On the contrary, the sample 1 helmet shell of the present invention has low temperature (34° C.) areas covering most portions of the shell. The temperature of the periphery of the shell of the sample 1 is even lower.

Figure 7:
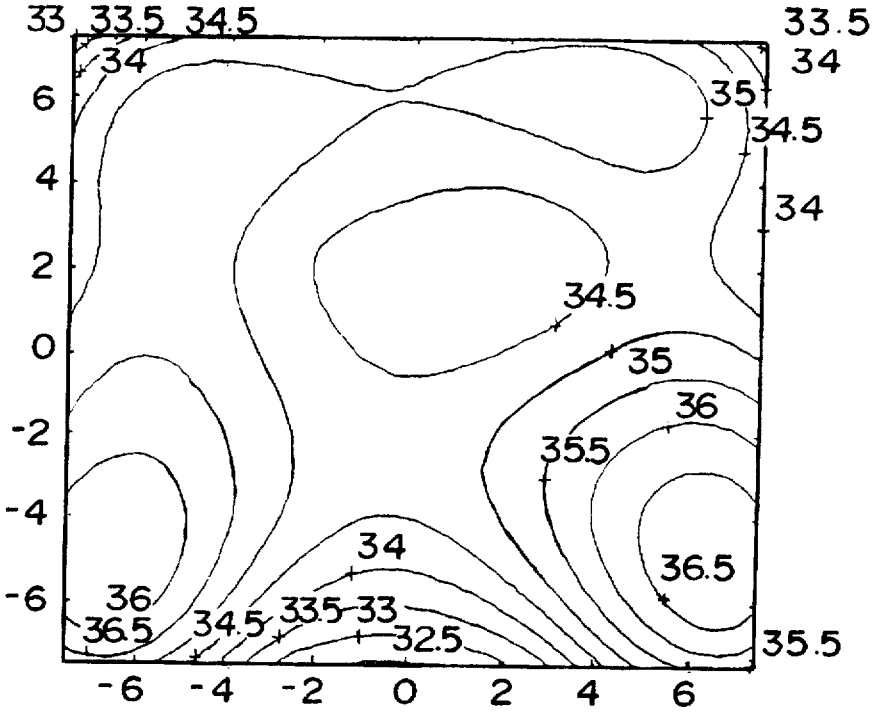
FIGS. 7, 8 and 9 are isothermal distribution diagrams of the sample 1, with the ventilation ports 121 on both sides of the helmet, the front lower ventilation port 106 and the front upper ventilation port 111 being sealed off, respectively.
Figure 8:
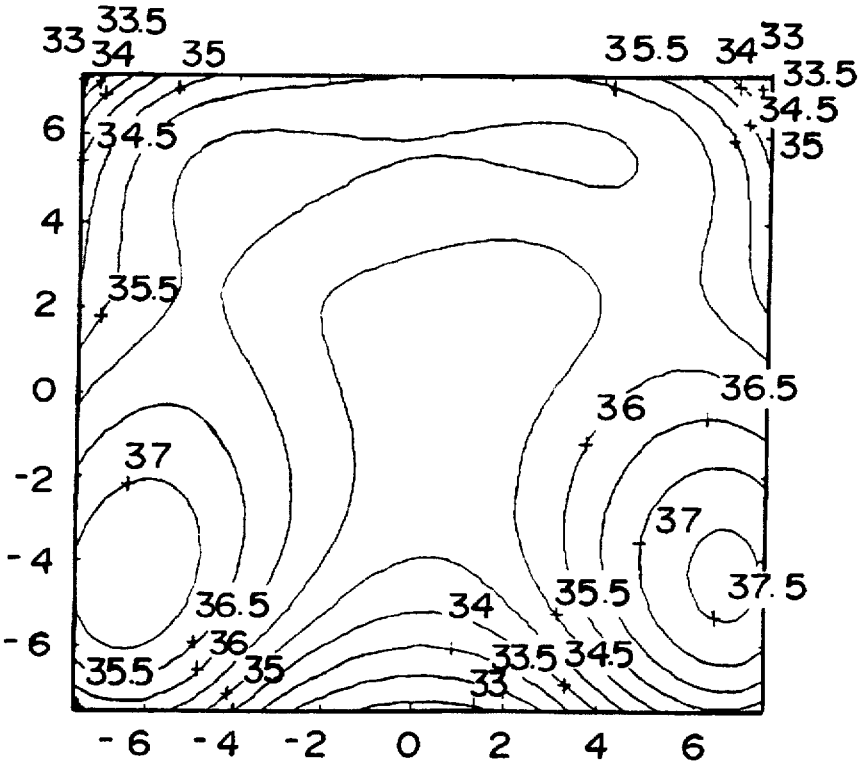
Figure 9:
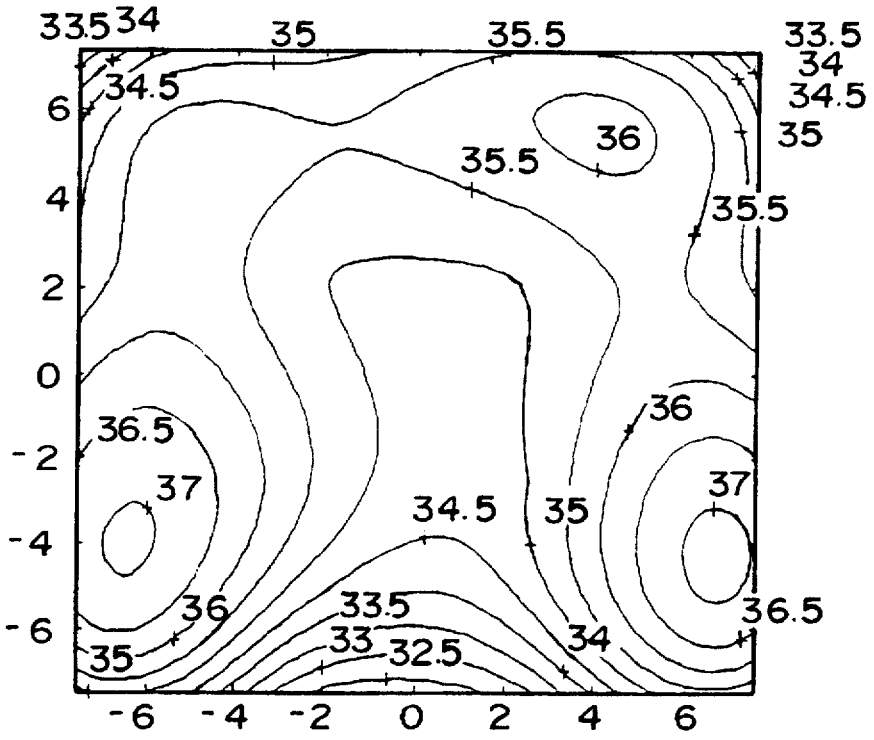

In order to test the impact of the ventilation port on the temperature, the ventilation ports of the shell of the sample 1 of the present invention were blocked in various forms. The ventilation port 160 of the sample 1 was already sealed off. For example, the ventilation holes 121, 106 or 111 of the shell of the sample 1 were obstructed. The isothermal lines are presented in FIGS. 7, 8 and 9. For more details, please refer to Table 2 containing the temperature data obtained under various conditions. The relative positions of the temperature data of Table 2 are corresponding to the thermal couples plotted in FIG. 3. Unless it is indicated otherwise, the data of the following isothermal lines were obtained at the wind velocity of 2.5 m/s.

TABLE 2

Temperature Test Data of Sample 1 Safety Helmet (Front Side Facing Wind)

rear ventilation port 160 being blocked;

| | | | | |
|---|---|---|---|---|
| Temperature | 32.8 | 34.1 | 34.3 | 33.1 |
| °C. | 33.4 | 33.9 | 34.2 | 33.7 |
| | 34.8 | 34.7 | 34.1 | 35.0 |
| | 34.5 | 32.4 | 32.4 | 35.0 |

TABLE 2-continued

| Temperature Test Data of Sample 1 Safety Helmet (Front Side Facing Wind) | | | | |
|---|---|---|---|---|
| rear and side ventilation ports 160 and 121 being blocked | | | | |
| Temperature | 32.3 | 34.0 | 35.5 | 33.8 |
| °C. | 34.7 | 34.6 | 34.1 | 34.0 |
| | 35.7 | 35.0 | 35.3 | 36.1 |
| | 35.1 | 32.8 | 33.1 | 35.4 |
| rear and front lower ventilation ports 160 and 106 being blocked | | | | |
| Temperature | 32.7 | 35.3 | 35.5 | 32.9 |
| °C. | 35.0 | 35.6 | 35.2 | 34.8 |
| | 36.7 | 36.4 | 35.1 | 37.1 |
| | 35.3 | 33.4 | 33.3 | 35.6 |
| rear and front upper ventilation ports 160 and 111 being blocked | | | | |
| Temperature | 33.0 | 34.8 | 35.5 | 33.3 |
| °C. | 35.1 | 35.1 | 35.1 | 34.8 |
| | 36.6 | 35.6 | 35.0 | 36.7 |
| | 34.8 | 32.6 | 32.9 | 35.1 |

When the ventilation ports on both sides were blocked, the hot point temperatures of both sides of the front rim of the shell were slightly higher. The similar results were obtained when the front lower ventilation port and the front upper ventilation port were blocked, with the difference that the hot point temperatures at the peak are greatly affected.

The temperature performances under these three kinds of conditions were poorer than the condition of FIG. 5 in which only the rear ventilation port 160 was blocked. It is therefore apparent that the ventilation port has an impact on the heat dissipation.

Figure 10:
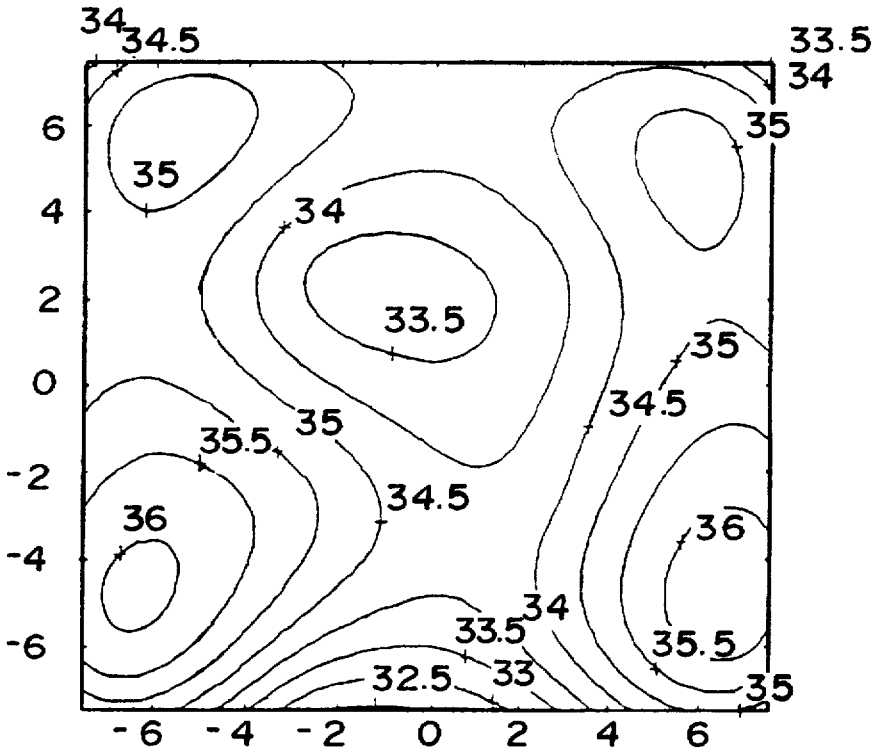
FIG. 10 is an isothermal distribution diagram of the sample 1 having additional six holes 150.
Figure 11:
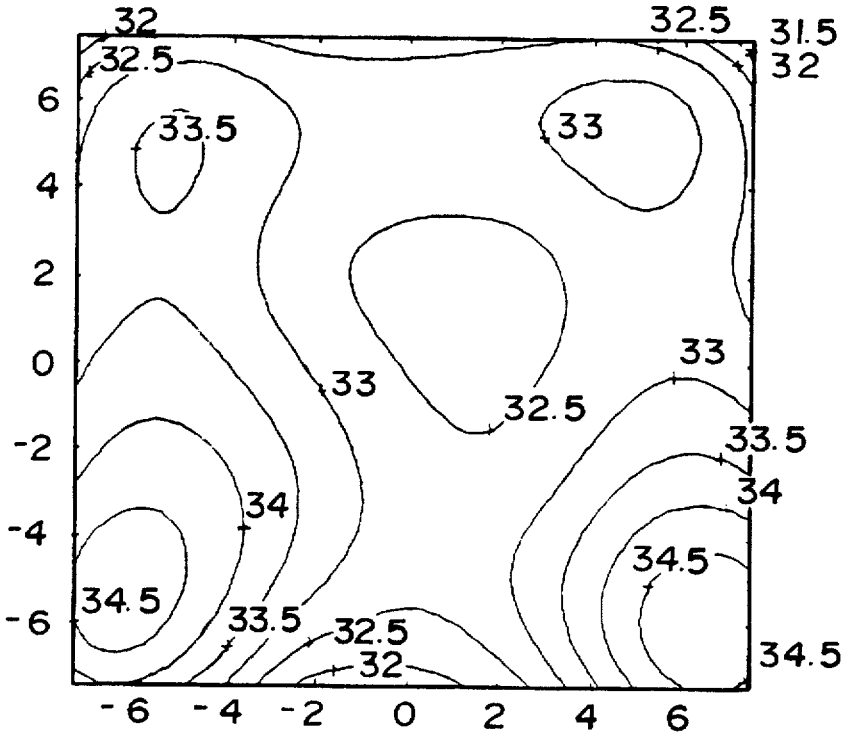
FIG. 11 is an isothermal distribution diagram of the sample 1 with its rear ventilation port 160 being unblocked.

On the basis of a series of isothermal line drawings shown in FIGS. 5, 7, 8 and 9, it is readily apparent that the partial areas of both sides of the front rim of the sample 1 safety helmet have high temperature. According to the general concept, this problem can be solved by providing respectively at both sides of the front rim of the shell with additional three (a total of six) ventilation holes 150 (having a diameter of 5 mm), as shown in FIG. 36. However, the results obtained in the experiment proved otherwise. FIG. 10 contains the isothermal lines of the sample 1 safety helmet provided at the front side thereof with additional six holes 150. As compared with FIG. 5, it can be seen that the reduction in temperature is not attained by an addition of six holes in the front side of the shell, and that such an approach is not useful in obtaining an expected target. FIG. 11 contains the isothermal line drawings of the sample 1 safety helmet with its rear ventilation port 160 being unblocked. As shown in FIG. 37, and as compared with FIG. 5 in which the rear ventilation port 160 was blocked, it is readily apparent that the temperature of each portion of the shell is improved, with the improvement degree reaching 30.8%. The results shown in FIGS. 10 and 11 indicate that the position of the ventilation port relative to the air duct has a greater impact on the temperature reduction.

The heat dissipation experiment of the sample 1 was conducted under the conditions that various ventilation ports of the sample 1 were blocked, and that various wind directions and wind velocities were employed. The results of the experiment are presented in Table 3.

TABLE 3

| Temperature Test Data of Sample 1 Safety Helmet With Various Wind directions and Wind velocities | | | | |
|---|---|---|---|---|
| rear ventilation port 160 being blocked; addition of six holes 150 in the front side; front side facing wind; wind speed 2.5 m/sec | | | | |
| Temperature | 33.8 | 34.5 | 34.1 | 33.4 |
| °C. | 34.5 | 33.4 | 33.8 | 34.7 |
| | 35.4 | 35.0 | 34.3 | 35.8 |
| | 34.5 | 32.6 | 33.3 | 34.7 |
| rear ventilation port 160 being open; front side facing wind; wind speed 2.5 m/sec | | | | |
| Temperature | 31.5 | 32.3 | 32.4 | 31.1 |
| °C. | 33.0 | 32.7 | 32.4 | 32.3 |
| | 33.9 | 33.5 | 32.7 | 33.5 |
| | 33.7 | 32.0 | 32.4 | 34.3 |
| rear ventilation port 160 being open; front upper ventitation port 111 being blocked; front side facing wind; wind speed 2.5 m/sec | | | | |
| Temperature | 32.0 | 32.6 | 33.3 | 31.6 |
| °C. | 33.0 | 32.4 | 34.5 | 33.5 |
| | 35.0 | 33.7 | 33.6 | 34.5 |
| | 33.9 | 32.2 | 32.8 | 34.2 |
| rear ventilation port 160 being open; front lower ventilation port 106 being blocked; front side facing wind; wind speed 2.5 m/sec | | | | |
| Temperature | 31.4 | 32.8 | 33.5 | 32.0 |
| °C. | 32.3 | 33.5 | 33.0 | 33.0 |
| | 34.7 | 33.5 | 33.9 | 34.0 |
| | 33.6 | 32.6 | 32.5 | 33.0 |
| rear ventilation port 160 being btocked; lateral side facing wind; wind speed 2.5 m/sec | | | | |
| Temperature | 30.7 | 32.4 | 31.4 | 30.1 |
| °C. | 32.8 | 31.8 | 30.7 | 30.4 |
| | 37.4 | 38.4 | 32.6 | 32.6 |
| | 35.3 | 37.0 | 35.7 | 33.0 |
| rear ventilation port 160 being blocked; rear side facing wind; wind speed 2.5 m/sec | | | | |
| Temperature | 31.8 | 34.5 | 34.0 | 31.8 |
| °C. | 33.2 | 36.5 | 36.4 | 34.0 |
| | 35.9 | 38.0 | 37.2 | 36.5 |
| | 34.3 | 37.0 | 37.4 | 35.0 |
| rear ventilation port 160 being open; rear side facing wind; wind speed 2.5 m/sec | | | | |
| Temperature | 31.0 | 34.5 | 33.8 | 31.6 |
| °C. | 33.6 | 34.8 | 34.1 | 33.0 |
| | 36.2 | 37.1 | 36.8 | 37.0 |
| | 34.2 | 36.5 | 36.0 | 35.0 |
| rear ventilation port 160 being open; front upper ventilation port 111 being blocked; rear side facing wind; wind speed 2.5 m/sec | | | | |
| Temperature | 31.9 | 32.9 | 33.6 | 30.9 |
| °C. | 33.0 | 34.3 | 34.0 | 33.2 |
| | 35.0 | 38.4 | 39.0 | 34.4 |
| | 34.7 | 36.5 | 36.9 | 35.0 |
| rear ventilation port 160 being open; front lower ventilation port 106 being blocked; rear side facing wind; wind speed 2.5 m/sec | | | | |
| Temperature | 31.6 | 33.3 | 34.0 | 30.5 |
| °C. | 33.2 | 34.0 | 34.0 | 32.7 |
| | 35.6 | 36.0 | 36.4 | 36.4 |
| | 34.7 | 36.7 | 37.1 | 35.0 |
| all ventilation ports being blocked; front side facing wind; wind speed 2.5 m/sec | | | | |
| Temperature | 35.2 | 32.6 | 32.6 | 35.1 |
| °C. | 35.3 | 35.2 | 35.1 | 35.4 |
| | 34.8 | 34.2 | 34.8 | 34.3 |
| | 33.2 | 34.8 | 34.5 | 33.6 |
| rear ventilation port 160 being open; front upper ventilation port 111 being blocked; lateral side facing wind; wind speed 2.5 m/sec | | | | |
| Temperature | 31.4 | 32.1 | 31.8 | 30.4 |
| °C. | 33.1 | 32.4 | 31.4 | 30.1 |
| | 35.3 | 36.0 | 33.7 | 33.0 |

TABLE 3-continued

| Temperature Test Data of Sample 1 Safety Helmet With Various Wind directions and Wind velocities | | | | |
|---|---|---|---|---|
| | 34.7 | 34.7 | 34.7 | 31.6 |
| rear ventilation port 160 being open; front lower ventilation port 106 being blocked; lateral side facing wind; wind speed 2.5 m/sec | | | | |
| Temperature | 32.1 | 32.4 | 32.1 | 30.4 |
| °C. | 33.5 | 32.4 | 31.1 | 30.1 |
| | 36.4 | 37.0 | 35.7 | 32.6 |
| | 34.7 | 34.3 | 34.3 | 32.0 |
| rear ventilation port 160 being blocked; front side facing wind; wind speed 1.1 m/sec | | | | |
| Temperature | 33.5 | 35.9 | 36.5 | 33.8 |
| °C. | 35.8 | 38.6 | 37.9 | 36.2 |
| | 39.7 | 37.0 | 37.1 | 40.4 |
| | 37.7 | 34.7 | 35.0 | 38.0 |
| rear ventilation port 160 being blocked; lateral side facing wind; wind speed 1.1 m/sec | | | | |
| Temperature | 34.2 | 35.5 | 34.5 | 31.8 |
| °C. | 37.2 | 36.5 | 32.8 | 30.8 |
| | 41.1 | 39.7 | 34.3 | 35.7 |
| | 39.0 | 38.4 | 39.0 | 34.0 |
| rear ventilation port 160 being blocked; rear side facing wind; wind speed 1.1 m/sec | | | | |
| Temperature | 31.8 | 33.8 | 33.8 | 31.8 |
| °C. | 35.2 | 37.2 | 36.9 | 35.8 |
| | 41.2 | 42.1 | 42.0 | 40.9 |
| | 36.9 | 39.4 | 41.1 | 37.5 |

By comparing various sets of the experimental data, it can be seen that the best comprehensive effect is attained under the conditions that the front lower ventilation port 106 of the sample 1 is blocked, and that the rear ventilation port 160 of the sample 1 is unblocked.

EXPERIMENT 2

The experiment 2 was carried out with the sample 1 and the sample 2 of the present invention, as shown in FIG. 34, in accordance with the experimental procedures of the Experiment 1. The cooling rate drawings and the isothermal distribution drawings of the Experiment 2 are shown in FIGS. 12–16.

Figure 12:
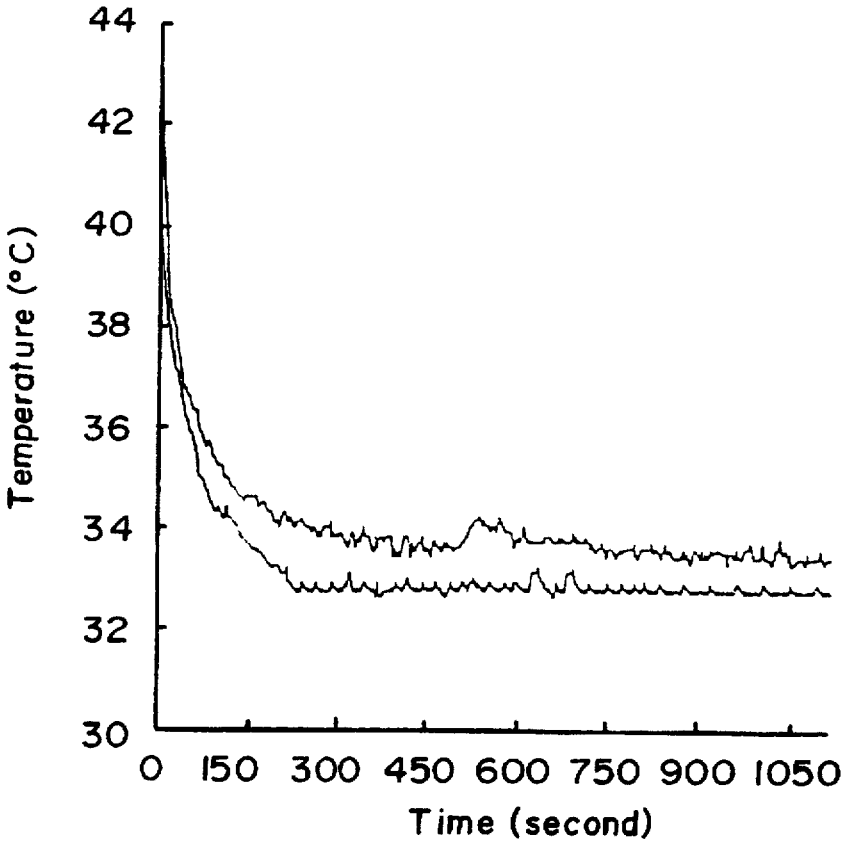
FIG. 12 is a diagram comparing the cooling rate curves of the sample 1 of the first preferred embodiment of the present invention and the sample 2 of a second preferred embodiment of the present invention, with the rear ventilation port 160 of the sample 1 being blocked.

FIG. 12 is a drawing comparing the cooling rates of the sample 1 and the sample 2 of the industrial safety helmets of the present invention. The lines located in the upper portion are the conditions of the sample 1 safety helmet while the lines located in the lower portion are the cooling rate curves of the sample 2 safety helmet. The sample 2 has more ideal initial or final average temperature than the sample 1. The initial and the final temperatures of the sample 2 and the sample 1 are respectively (40.4° C., 32.7° C.) and (43.3° C., 33.4° C.). In comparing the temperature reduction rate, it was found that both samples 2 and 1 reached the average temperature in about 220 seconds, and that the performance of the sample 2 was more stable, and further that the sample 2 had a lower final average temperature.

Figure 13:
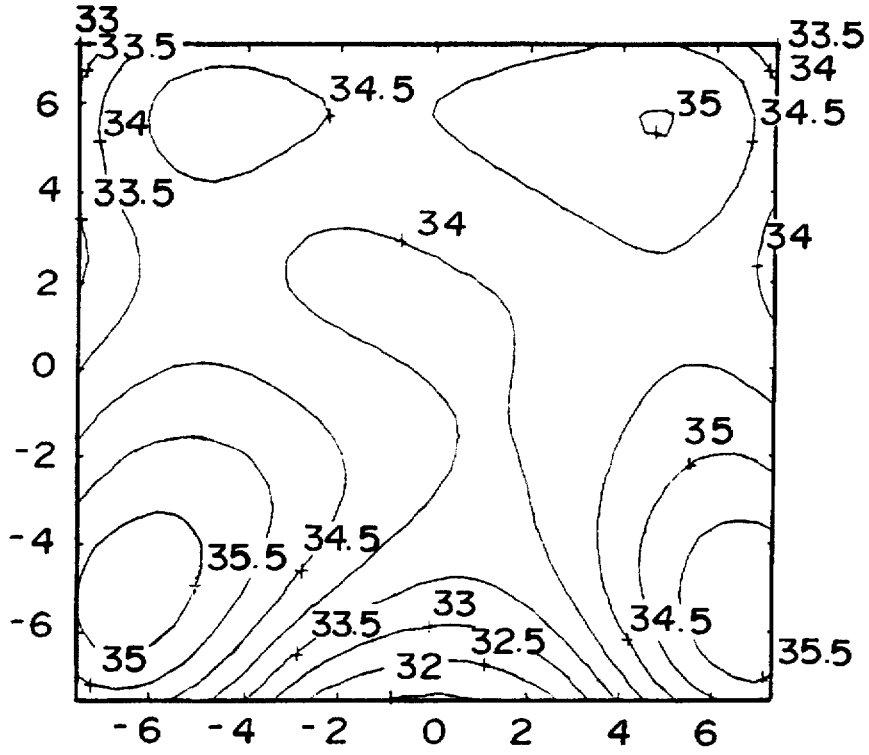
FIGS. 13 and 14 are isothermal distribution diagrams of the sample 1 and the sample 2, with the front sides of the shells of the samples 1 and 2 facing the wind.
Figure 14:
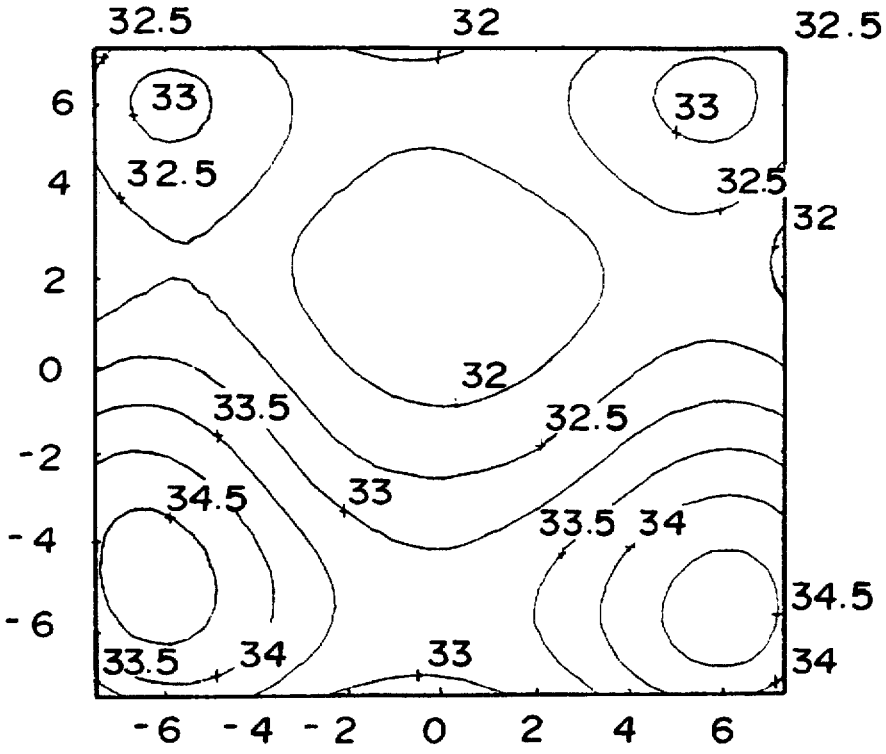

FIGS. 13 and 14 illustrate the testing of the sample 1 and 2, with the front sides of the samples 1 and 2 facing the wind. Let us first compare the conditions of the front sides facing the wind. The hot point areas of both sides of the front end of the peak of the sample 2 are milder than those of the sample 1. The isothermal lines of the sample 2 are distributed more sparsely to indicate the uniform distribution of temperatures. The sample 2 has a lower average temperature. Let us compare again the conditions of the areas having 32° C. The 32° C. area of the sample 1 is confined to the peak while the 32° C. areas of the sample 2 extend into the interior of the shell as well as the rear side and the lateral sides of the shell.

Figure 15:
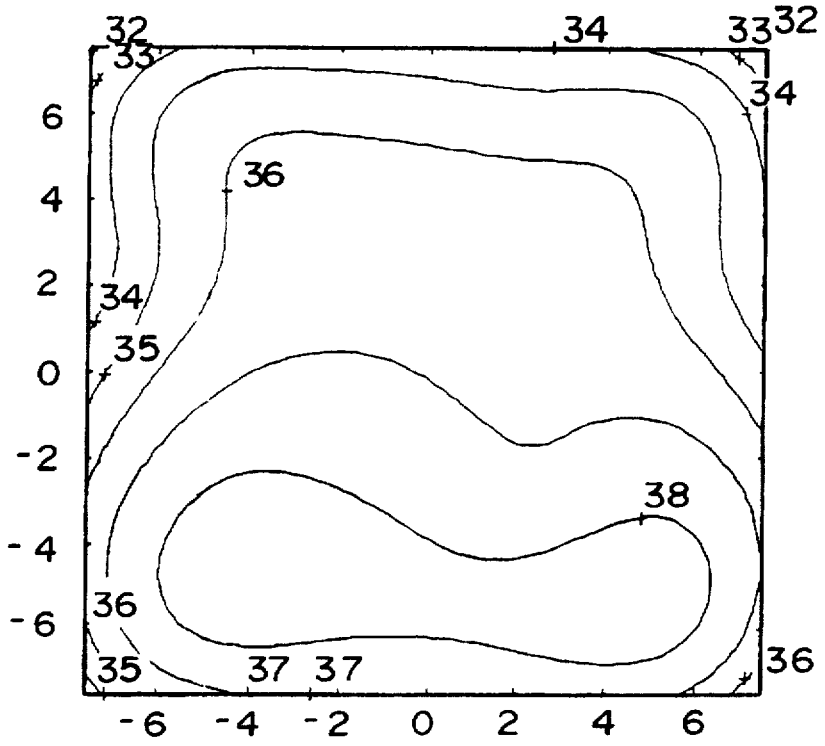
FIGS. 15 and 16 are isothermal distribution diagrams of the sample 1 and 2, with the back sides of the shells of the samples 1 and 2 facing the wind.
Figure 16:
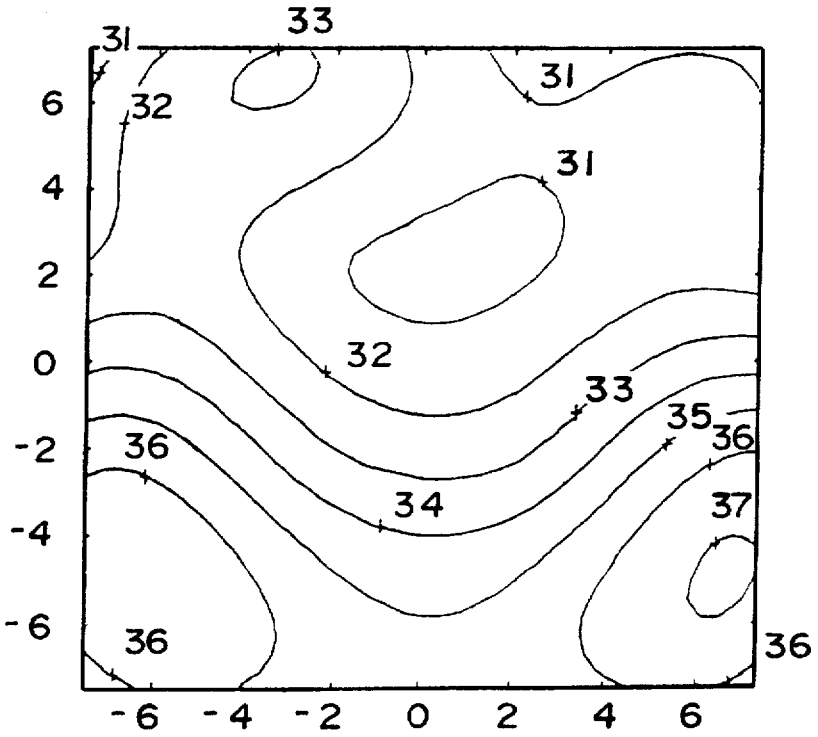

FIGS. 15 and 16 illustrate the conditions of the samples 1 and 2, with the back sides of the samples 1 and 2 facing the wind. The central area of the shell of the sample 2 has a temperature which is about 4°–5° C. lower than the temperature of the central area of the sample 1 shell. It is therefore apparent that the sample 2 with an unblocked backside ventilation port is capable of attaining an expected ideal target.

EXPERIMENT 3

Figure 17:
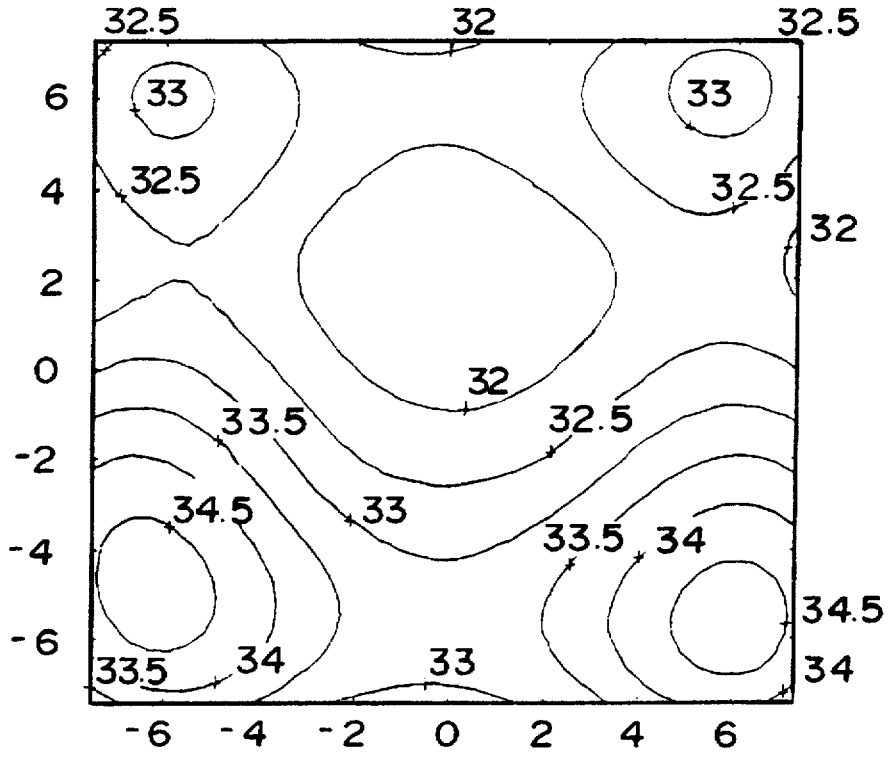
FIGS. 17 and 18 are isothermal distribution diagrams of the sample 1, with the shell top of the sample 1 having a light reflecting paper attached thereto, and with the shell top of another sample 1 being devoid of the light reflecting paper, respectively.
Figure 18:
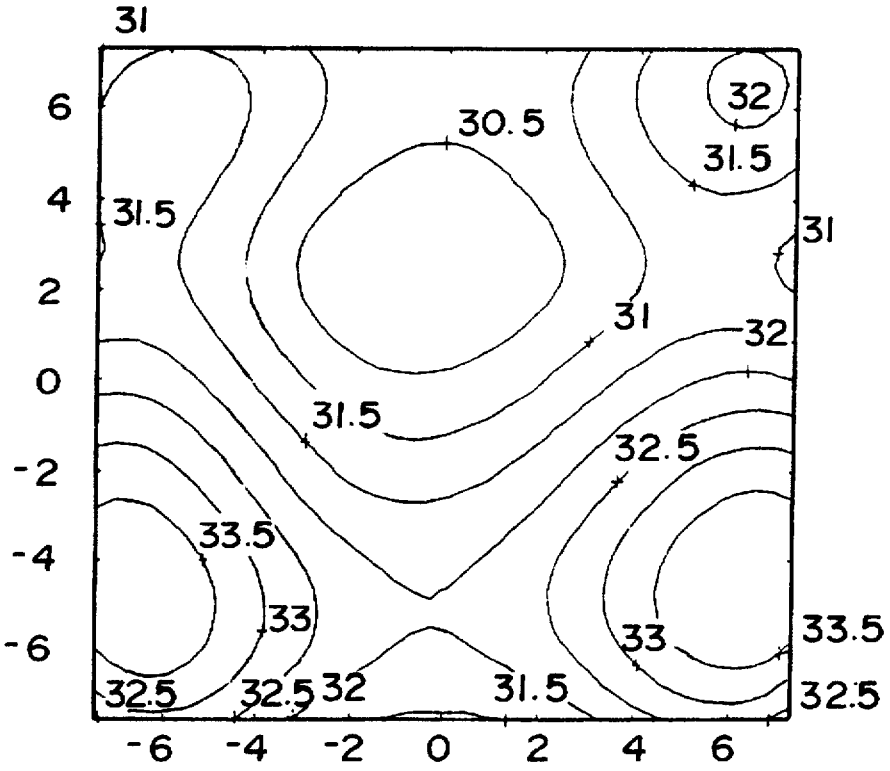
Figure 38:
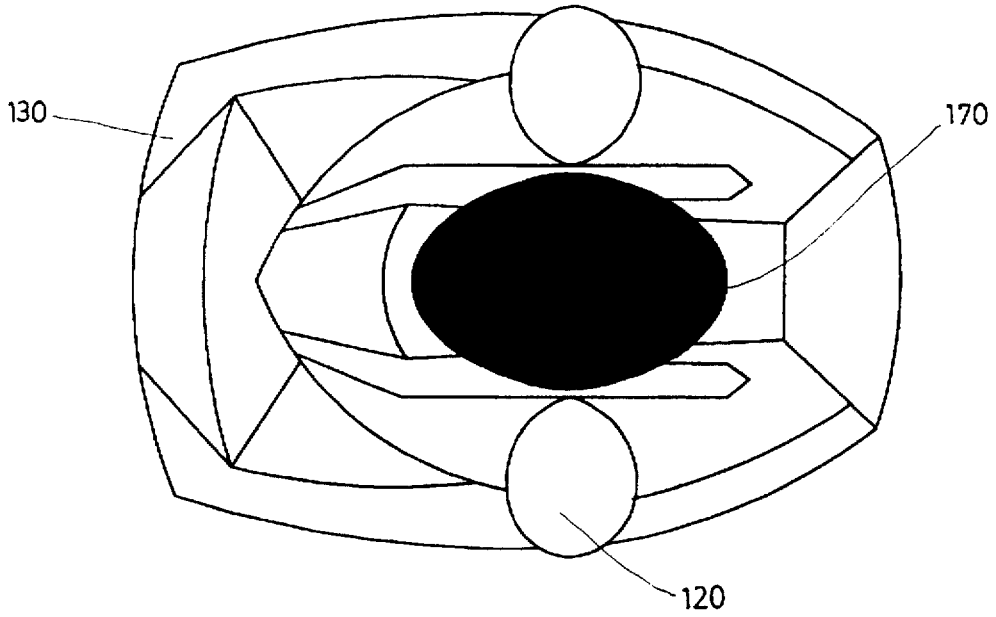
FIG. 38 shows a top view of the helmet shell of the second preferred embodiment of the present invention, with the helmet shell having a light reflecting paper attached thereto.

The temperature distributions of a sample 2 without a light-reflecting paper adhered therewith, and a sample 2 with a light-reflecting paper 170 attached thereto as shown in FIG. 38, were studied. The test results are shown in FIGS. 17 and 18, which suggest that the sample with the light-reflecting paper attached thereto is more satisfactory in that its average temperature is close to the test environment temperature.

EXPERIMENT 4

Figure 19A:
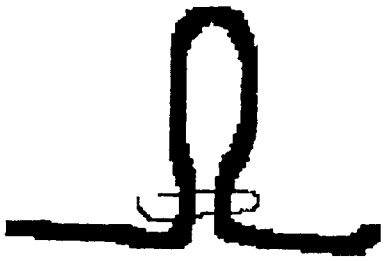
FIGS. 19(*a*) and 19(*b*) are schematic views of the L-type folding and the Z-type folding.
Figure 19B:
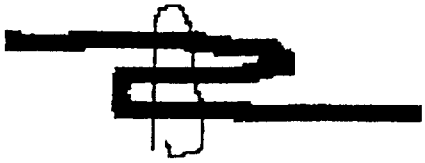

The tension experiment was done with an L-type folding as shown in FIG. 19(*a*), and a Z-type folding as shown in FIG. 19(*b*) in conjunction with four different sewing patterns and three different sewing threads of different diameters, 30/2, 60/2 and 100/2. The tension test results are presented in Table 4. The following two conclusions can be arrived at by inferring the data presented in Table 4.

(1). Among six samples, the sample 2 has the best result, with the average maximum destructive tension being as high as 30.31 kgf after the sample 2 is provided with 60/2 sewing thread.

(2). The average destructive tension is directly proportional to the diameter of the sewing thread.

On the basis of the data presented in Table 4, it can be seen that the destructive tension values of the samples can be different considerably even if the samples are provided with the same sewing pattern and the sewing threads having the same diameter. This implies that the sewing quality has a great impact on the results. The performance and the reliability of the product can be therefore adversely affected by the substandard sewing.

TABLE 4

Test Results of L-type Folding Sewn By Various Sewing Patterns and With Sewing Threads of Various Diameters

| Sample No. | Sewing Patterns | | $P_{max}$ (kgf) | Average |
|---|---|---|---|---|
| sample 1 | - - | 1 | 16.30 | 16.45 |
| | 60/2 | 2 | 15.20 | |
| | with reverse | 3 | 17.45 | |
| | sewing | 4 | 15.75 | |
| | | 5 | 17.55 | |
| sample 2 | Z | 1 | 27.15 | 30.31 |
| | 60/2 | 2 | 30.50 | |
| | | 3 | 29.00 | |
| | | 4 | 30.90 | |
| | | 5 | 34.00 | |
| sample 3 | = = | 1 | 5.50 | 6.91 |
| | 60/2 | 2 | 7.60 | |
| | without | 3 | 5.45 | |
| | reverse | 4 | 9.10 | |
| | sewing | 5 | | |
| sample 4 | = = | 1 | 7.28 | 7.23 |
| | 100/2 | 2 | 6.70 | |
| | contraction | 3 | 6.24 | |
| | | 4 | 7.25 | |
| | | 5 | 8.70 | |
| sample 5 | 60/2 | 1 | 12.38 | 22.05 |
| | complete | 2 | 24.50 | |
| | reverse | 3 | 27.48 | |
| | sewing | 4 | 24.68 | |
| | | 5 | 21.23 | |

TABLE 4-continued

Test Results of L-type Folding Sewn By Various Sewing Patterns and With Sewing Threads of Various Diameters

| Sample No. | Sewing Patterns | | $P_{max}$ (kgf) | Average |
|---|---|---|---|---|
| sample 6 | 30/2 | 1 | 13.45 | 15.06 |
| | complete | 2 | 16.45 | |
| | reverse | 3 | 13.63 | |
| | sewing | 4 | 15.83 | |
| | | 5 | 15.95 | |

According to the sample 1 of Table 4, the destructive force of about 160 N is needed at one sewn area. If the shell is provided with a total of four sewn foldings on the two woven straps of the cradle, there are four sewn areas capable of absorbing the impact force of 640 N.

Figure 20:
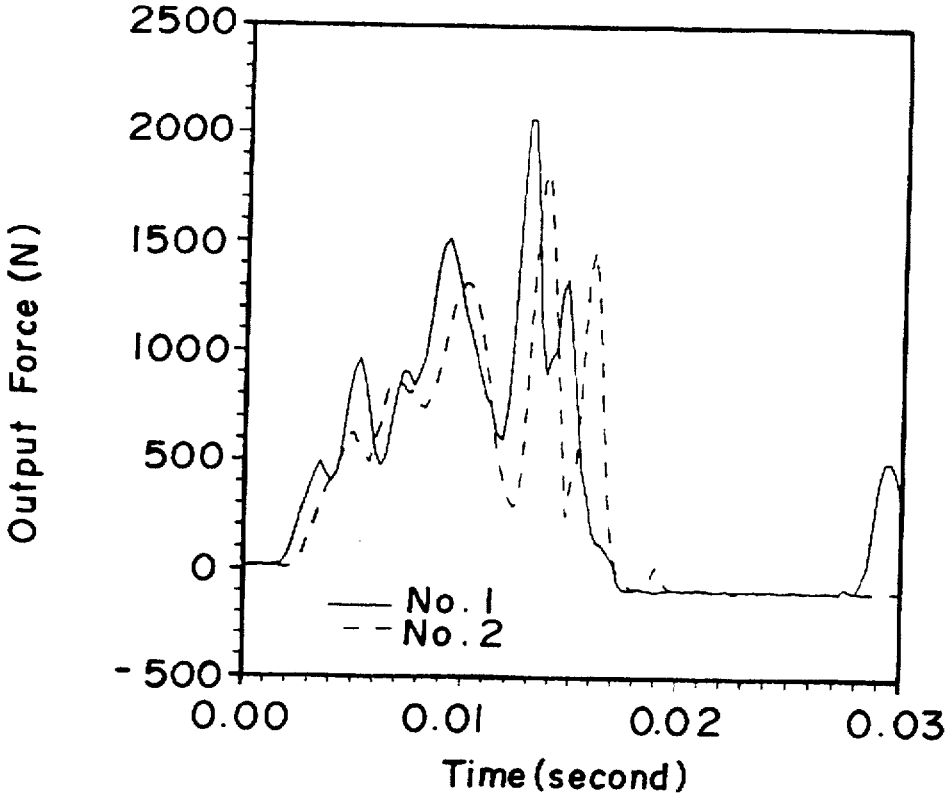
FIGS. 20 and 21 show the impact test results of the cradle samples of the present invention, with the cradle samples having the L-type folding which are sewn by different patterns. The output force is shown in the longitudinal axis while the time is shown in the horizontal axis.
Figure 21:
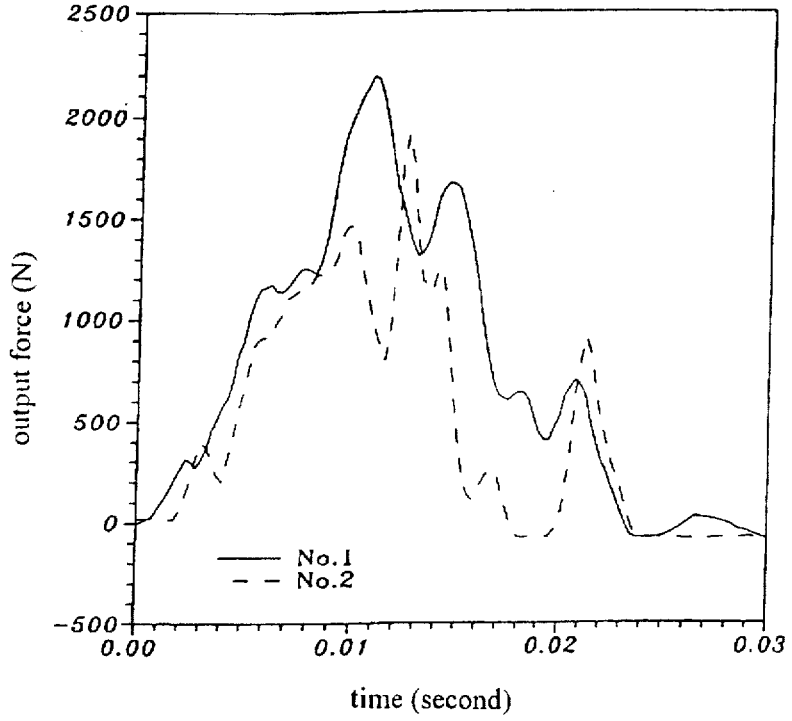

The impact experiment was done with the woven cradle having an improved L-type folding in conjunction with the shell of the industrial safety helmet sold by Bullard, 5100, E. D. Bullard Co., Cynthiana, Ky., U.S.A. Before improvement, the average impact force exerting on the head is 1964 N. FIG. 20 contains the test results of the sample 5. The impact force exerting on the head is 2069 N, if the sewing at four folding points are totally severed (No. 1). The impact force exerting on the head is 1830 N if the sewing at three folding points are severed (No. 2). The test results of the sample 6 are shown in FIG. 21, with all four sewing points being totally severed and with the average impact force being 2052 N. These test results suggest that the total severance of the sewn area can result in the head being exerted on by an impact force which is greater than the result of the test in which no folding is provided. However, if the sewn area is not totally severed, the impact force exerting on the head is greatly reduced. This is due to the fact that an extra impact is brought about at the moment when the severance of the sewn area stretches the folding. As a result, the impact force exerting on the head is increased. On the basis of the above analyses and discussions, it is concluded that the L-type folding is not a desirable design.

Figure 22:
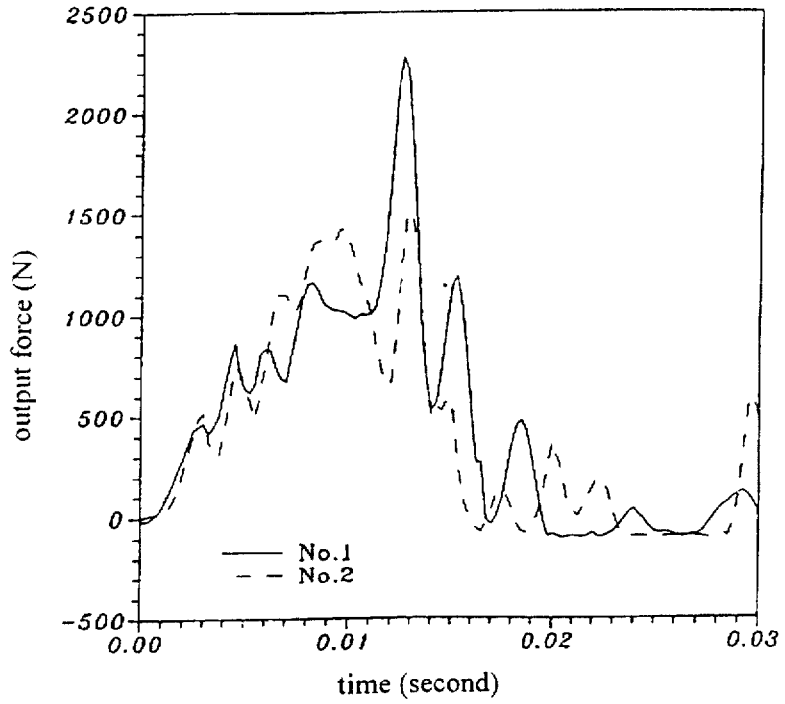
FIGS. 22 and 23 show the impact test results of the cradle samples having the Z-type folding which are sewn by different patterns. The output force is shown in the longitudinal axis while the time is shown in the horizontal axis.
Figure 23:
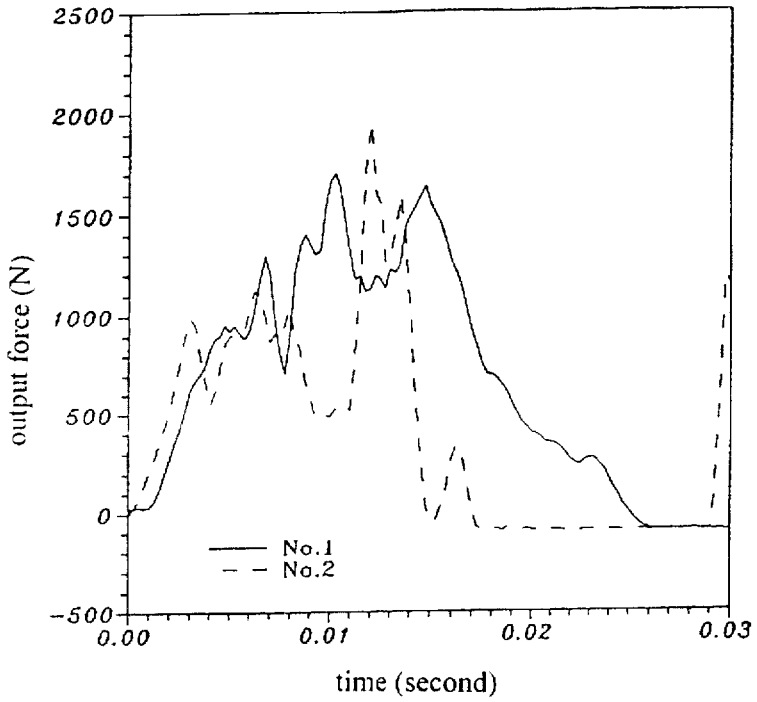

The test was further carried out with the Z-type folding. The test results are shown in FIGS. 22 and 23. The average forces exerting on the head are respectively 1835 N and 1849 N when the sewing threads of 30/2 and 60/2 are used. These impact forces are lower than the test result of 2030 N obtained before the improvement was done. It is therefore readily apparent that the Z-type folding is effective in reducing the magnitude of the impact force exerting on the head, with the reason being that the sewing thread has a resistance against an external force when the folding is exerted on by the external force, and that the folded woven portions of the straps affords a friction effect.

EXPERIMENT 5

The experiment was carried out by making use of the black rubber pad and the voltage-resistant rubber, which served as the dampers between the insertion element 320 of the cradle 200 and the receiving slot 170 of the shell 100. The impact experiment was done.

Figure 24:
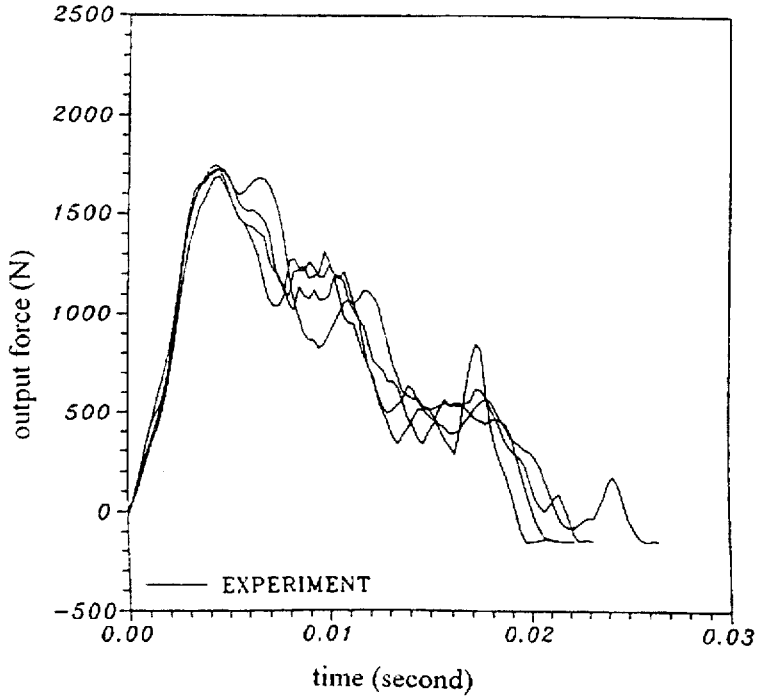
FIGS. 24 and 25 show the impact test results of two damper samples of the present invention. The output force is shown in the longitudinal axis while the time is shown in the horizontal axis.
Figure 25:
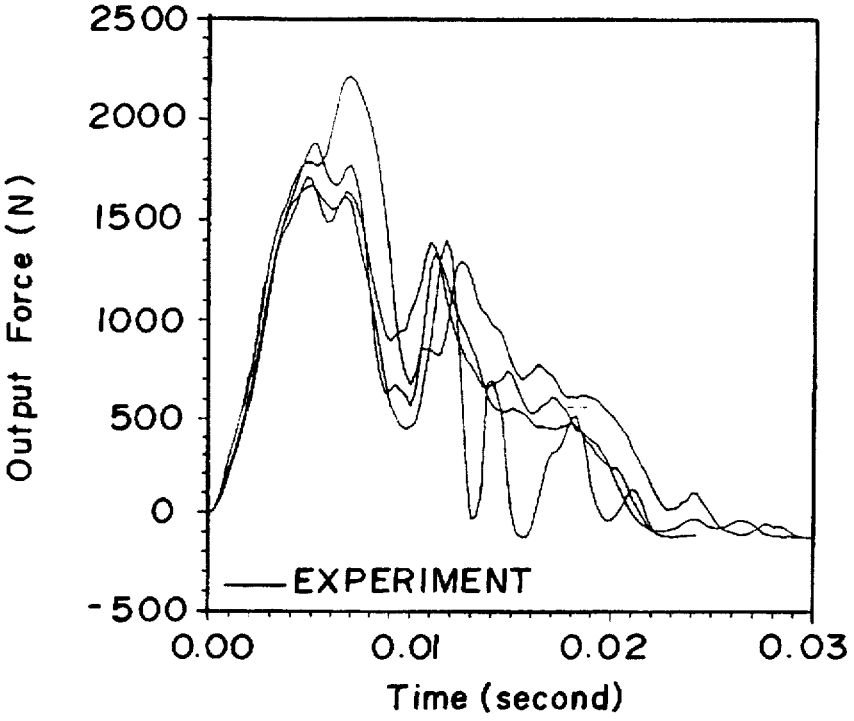

The test results of the black pad are shown in FIG. 24. The average maximum impact force obtained in four testing is about 1720 N, which is about 55% of the theoretical value of 3113 N before the improvement. The test results of the voltage-resistant rubber are shown in FIG. 25 and are suggestive of the effectiveness in reducing the force exerting on the head. The average force exerting on the head is 1770 N, which is slightly higher than that obtained in the testing of the black rubber pad. It can be noted in the drawings that one test result is rather different from other three test results. The reason for such a discrepancy may be due to the fact that the test samples were made manually and that the quality of the test samples was therefore compromised.

It is concluded that the connection mechanism provided with an added pad of a rubber material is effective in reducing the impact force exerting on the head wearing a safety helmet when the safety helmet is impacted by an external force. The reduction in the impact force is as great as 45%. The black rubber pad is superior in the energy absorbing effect to the voltage-resistant rubber. However, the voltage-resistant rubber is recommended when a specific need is called for in the work site.

EXPERIMENT 6: CRITICAL IMPULSE TEST OF CHIN STRAP

The experiment was carried out by making use of the chin straps 400 having four different adhesive buckling straps of various areas of 38.1 mm×20 mm, 25.4 mm×20 mm, 38.1×16 mm, and 25.4 mm×16 mm. The dynamic impulse experiment was done such that five test samples of each kind of adhesive buckling strap were used. The adhesive buckling strap was fastened by sewing with a strap having a predetermined length. The strap is fastened securely at one end thereof with a test frame and at another end thereof with a balance weight which is 1 kgw in weight and is fastened with a rope.

The magnitude of the impulse was changed by changing the height of the balance weight, with the change in height taking place from a large increment to a smaller increment. The critical height was determined by a height at which the adhesive buckling strap remained engaged when the adhesive buckling strap was finally impacted with the minimum increment. The test was carried out repeatedly for each adhesive buckling strap for 9–11 times, depending on the critical value of the height of the impulse exerting on the adhesive buckling strap. The test results are presented in Table 5–8. The symbol "O" indicates that the adhesive buckling strap remains engaged after being impacted. The symbol "X" indicates that the adhesive buckling strap is disengaged after being impacted. The symbol "X̸" indicates the critical height. The letters "h" and "n" stands respectively for the impact height and the times that the test was carried out repeatedly. In the experiment, the impact base height was 78 cm.

TABLE 5 adhesive buckling strap area (38.0 mm × 20 mm)

| h\n | 1 | 2 | 3 | 4 | 5 | 6 | 7 | 8 | 9 | 10 | 11 |
|---|---|---|---|---|---|---|---|---|---|---|---|
| | | | | | Specimen #1 | | | | | | |
| 140 | X | X | | | | | | | | | |
| 130 | X | X | X | X | | | | | | | |
| 125 | X | X | X | X | X | | | | | | |
| 120 | X | X | X | X | X | | | | | | |
| 115 | ○ | X | X | X | X | X | X | | | | |
| 110 | | X | X | X | X | X | X | X | X | X | |
| 100 | | ○ | X | X | ○ | X | X | X | X | X | |
| 95* | | | ○ | ○ | | ○ | ○ | ○ | ○ | ○ | |
| 94 | | | | | | | | | | | |
| 93 | | | | | | | | | | | |
| 92 | | | | | | | | | | | |
| 91 | | | | | | | | | | | |

TABLE 5-continued

| | adhesive buckling strap area (38.0 mm × 20 mm) | | | | | | | | | | |
|---|---|---|---|---|---|---|---|---|---|---|---|
| h\n | 1 | 2 | 3 | 4 | 5 | 6 | 7 | 8 | 9 | 10 | 11 |
| | | | | | Specimen #2 | | | | | | |
| 140 | X | X | X | | | | | | | | |
| 130 | X | X | X | X | | | | | | | |
| 125 | X | X | X | X | | | | | | | |
| 120 | X | X | X | X | X | | | | | | |
| 115 | ○ | X | X | X | X | | | | | | |
| 110 | | X | X | X | X | X | | | | | |
| 100 | ○ | | | X | X | X | X | X | X | | |
| 95 | | ○ | ○ | ○ | X | X | X | X | X | | |
| 94* | | | | | ○ | ○ | ○ | ○ | | | |
| | | | | | Specimen #3 | | | | | | |
| 140 | X | | | | | | | | | | |
| 130 | X | X | X | X | | | | | | | |
| 125 | | | | | | | | | | | |
| 120 | X | X | X | X | | | | | | | |
| 115 | | | | | | | | | | | |
| 110 | X | X | X | X | | | | | | | |
| 100 | ○ | X | X | X | X | X | | | | | |
| 98 | | | | | X | X | | | | | |
| 96 | | | | | ○ | ○ | X | X | X | | |
| 95 | | ○ | ○ | ○ | | | ○ | ○ | X | X | X |
| 94 | | | | | | | | | X | X | X |
| 93* | | | | | | | | | ○ | ○ | ○ |
| | | | | | Specimen #4 | | | | | | |
| 140 | X | X | X | | | | | | | | |
| 130 | X | | | X | X | X | | | | | |
| 125 | | | | | | | | | | | |
| 120 | X | X | X | X | X | X | | | | | |
| 115 | X | X | X | X | X | X | | | | | |
| 110 | X | X | X | | | | | | | | |
| 105 | | ○ | X | X | X | X | | | | | |
| 100 | ○ | | ○ | ○ | X | X | X | | | | |
| 97 | | | | | | | | X | X | X | |
| 95* | | | | | ○ | ○ | ○ | ○ | ○ | ○ | |
| 94 | | | | | | | | | | | |
| 93 | | | | | | | | | | | |
| | | | | | Specimen#5 | | | | | | |
| 140 | X | X | X | | | | | | | | |
| 130 | X | X | | | | | | | | | |
| 120 | | | X | | | | | | | | |
| 115 | X | X | X | | | | | | | | |
| 110 | X | | | X | | | | | | | |
| 105 | X | X | X | X | X | | | | | | |
| 100 | | X | | X | X | X | | | | | |
| 95 | ○ | ○ | X | X | X | X | X | X | X | X | X |
| 94 | | | ○ | ○ | ○ | ○ | ○ | X | X | X | X |
| 93* | | | | | | | | ○ | ○ | ○ | ○ |
| 92 | | | | | | | | | | | |
| 91 | | | | | | | | | | | |

TABLE 6

| | adhesive buckling strap area (25.4 mm × 20 mm) | | | | | | | | | | |
|---|---|---|---|---|---|---|---|---|---|---|---|
| h\n | 1 | 2 | 3 | 4 | 5 | 6 | 7 | 8 | 9 | 10 | 11 |
| | | | | | Specimen #1 | | | | | | |
| 130 | X | | | | | | | | | | |
| 125 | | | | | | | | | | | |
| 120 | X | X | | | | | | | | | |
| 115 | | | | | | | | | | | |
| 110 | X | X | X | | | | | | | | |
| 105 | | | | | | | | | | | |
| 100 | X | X | X | X | X | | | | | | |
| 95 | X | X | X | X | X | | | | | | |
| 90 | X | X | X | X | X | X | | | | | |
| 85 | X | X | X | X | X | X | X | X | | | |

TABLE 6-continued

| | adhesive buckling strap area (25.4 mm × 20 mm) | | | | | | | | | | |
|---|---|---|---|---|---|---|---|---|---|---|---|
| h\n | 1 | 2 | 3 | 4 | 5 | 6 | 7 | 8 | 9 | 10 | 11 |
| 84 | X | X | ○ | ○ | X | ○ | X | X | X | X | X |
| 83* | ○ | ○ | | | ○ | | ○ | ○ | ○ | ○ | ○ |
| | | | | | Specimen #2 | | | | | | |
| 130 | X | | | | | | | | | | |
| 120 | X | X | X | | | | | | | | |
| 115 | | | | | | | | | | | |
| 110 | X | X | X | | | | | | | | |
| 105 | X | X | | | | | | | | | |
| 100 | X | X | X | X | | | | | | | |
| 95 | X | X | X | X | X | | | | | | |
| 90 | ○ | X | X | X | X | X | X | X | | | |
| 85 | | ○ | ○ | ○ | ○ | X | X | X | X | X | X |
| 84* | | | | | | ○ | ○ | ○ | ○ | ○ | ○ |
| 83 | | | | | | | | | | | |
| 82 | | | | | | | | | | | |
| | | | | | Specimen #3 | | | | | | |
| 130 | X | X | | | | | | | | | |
| 120 | X | X | X | X | X | | | | | | |
| 115 | | | | | | | | | | | |
| 110 | X | X | X | X | X | | | | | | |
| 105 | | | | | | | | | | | |
| 100 | X | X | X | X | X | | | | | | |
| 95 | X | X | X | X | X | | | | | | |
| 90 | X | X | X | X | X | | | | | | |
| 85 | ○ | ○ | X | ○ | X | X | X | X | X | X | X |
| 84 | | | ○ | | ○ | ○ | ○ | ○ | X | X | X |
| 83* | | | | | | | | | ○ | ○ | ○ |
| 82 | | | | | | | | | | | |
| | | | | | Specimen #4 | | | | | | |
| 130 | X | X | | | | | | | | | |
| 120 | X | X | X | | | | | | | | |
| 115 | X | X | | | | | | | | | |
| 110 | | X | X | | | | | | | | |
| 105 | X | X | | | | | | | | | |
| 100 | X | X | X | | | | | | | | |
| 95 | X | X | X | X | | | | | | | |
| 90 | X | X | X | X | X | | | | | | |
| 85 | ○ | X | X | X | X | | | | | | |
| 84 | | X | X | X | X | X | X | | | | |
| 83 | | ○ | ○ | ○ | ○ | ○ | X | X | X | X | |
| 82* | | | | | | | ○ | ○ | ○ | ○ | |
| | | | | | Specimen #5 | | | | | | |
| 130 | X | | | | | | | | | | |
| 120 | | | | | | | | | | | |
| 115 | X | X | | | | | | | | | |
| 110 | X | X | | | | | | | | | |
| 105 | X | X | | | | | | | | | |
| 100 | X | X | | | | | | | | | |
| 95 | X | X | X | X | | | | | | | |
| 90 | X | X | X | X | | | | | | | |
| 85 | X | X | X | X | X | X | | | | | |
| 84 | X | ○ | X | X | X | X | X | X | X | X | |
| 83* | ○ | | ○ | ○ | ○ | X | ○ | ○ | ○ | ○ | |
| 82 | | | | | | ○ | | | | | |

TABLE 7

| | adhesive buckling strap area (38.1 mm × 16 mm) | | | | | | | | | | |
|---|---|---|---|---|---|---|---|---|---|---|---|
| h\n | 1 | 2 | 3 | 4 | 5 | 6 | 7 | 8 | 9 | 10 | 11 |
| | | | | | Specimen #1 | | | | | | |
| 130 | X | X | X | | | | | | | | |
| 120 | X | X | | | | | | | | | |
| 115 | X | X | X | | | | | | | | |
| 110 | | | | X | X | | | | | | |
| 105 | X | X | X | X | X | | | | | | |

TABLE 7-continued

| | adhesive buckling strap area (38.1 mm × 16 mm) | | | | | | | | | | |
|---|---|---|---|---|---|---|---|---|---|---|---|
| h\n | 1 | 2 | 3 | 4 | 5 | 6 | 7 | 8 | 9 | 10 | 11 |
| 100 | | X | | X | | | | | | | |
| 95 | X | X | X | X | X | | | | | | |
| 90 | O | O | O | X | X | X | | | | | |
| 88 | | | | O | X | X | X | X | X | X | |
| 87 | | | | | O | O | X | X | X | X | |
| 85X | | | | | | | O | O | O | O | |
| 84 | | | | | | | | | | | |
| | | | | Specimen #2 | | | | | | | |
| 130 | X | X | X | | | | | | | | |
| 120 | X | X | X | | | | | | | | |
| 115 | X | | | | | | | | | | |
| 110 | X | X | X | | | | | | | | |
| 105 | X | | | | | | | | | | |
| 100 | X | X | X | | | | | | | | |
| 95 | X | X | | | X | | | | | | |
| 90 | O | X | X | X | X | X | | | | | |
| 89 | | X | X | X | X | X | X | X | X | | |
| 88X | | O | O | X | O | O | O | O | O | | |
| 87 | | | | O | | | | | | | |
| 86 | | | | | | | | | | | |
| | | | | Specimen #3 | | | | | | | |
| 140 | X | X | X | X | X | | | | | | |
| 130 | X | X | X | X | X | | | | | | |
| 120 | X | X | X | X | X | | | | | | |
| 110 | X | X | X | X | X | | | | | | |
| 105 | X | X | | | | | | | | | |
| 100 | X | X | X | X | X | X | X | | | | |
| 95 | O | X | O | O | X | X | X | X | | | |
| 90 | | O | | | O | O | O | X | X | X | X |
| 89 | | | | | | | | X | X | X | X |
| 88X | | | | | | | | O | O | O | O |
| 87 | | | | | | | | | | | |
| 86 | | | | | | | | | | | |
| | | | | Specimen #4 | | | | | | | |
| 140 | X | X | X | | | | | | | | |
| 130 | X | | | | | | | | | | |
| 120 | X | X | X | | | | | | | | |
| 110 | X | | | X | X | | | | | | |
| 105 | X | | | | | | | | | | |
| 100 | X | X | X | X | X | X | X | | | | |
| 95 | X | X | | X | X | X | X | X | | | |
| 90 | O | X | X | O | O | X | X | X | X | | |
| 89 | | O | O | | | X | X | X | X | X | X |
| 88 | | | | | | O | O | X | X | X | X |
| 87X | | | | | | | | O | O | O | O |
| 85 | | | | | | | | | | | |
| 84 | | | | | | | | | | | |
| | | | | Specimen #5 | | | | | | | |
| 140 | X | X | X | X | X | | | | | | |
| 130 | X | X | | | | | | | | | |
| 120 | X | X | X | X | X | | | | | | |
| 110 | X | X | | | | X | X | | | | |
| 100 | X | X | X | X | X | X | | | | | |
| 95 | O | X | X | X | X | X | X | | | | |
| 90 | | O | O | O | O | O | X | X | X | X | X |
| 89 | | | | | | | X | X | X | X | X |
| 88X | | | | | | | O | O | O | O | O |
| 87 | | | | | | | | | | | |
| 85 | | | | | | | | | | | |
| 84 | | | | | | | | | | | |

TABLE 8

| | adhesive buckling strap area (25.4 mm × 16 mm) | | | | | | | | | | |
|---|---|---|---|---|---|---|---|---|---|---|---|
| h\n | 1 | 2 | 3 | 4 | 5 | 6 | 7 | 8 | 9 | 10 | 11 |
| | | | | Specimen #1 | | | | | | | |
| 130 | X | X | X | | | | | | | | |
| 120 | X | | | | | | | | | | |
| 110 | X | X | X | X | | | | | | | |
| 100 | X | | | | | | | | | | |
| 95 | X | X | X | X | | | | | | | |
| 90 | X | X | X | X | | | | | | | |
| 85 | X | X | X | X | X | | | | | | |
| 84 | X | X | O | X | X | | | | | | |
| 83 | O | O | | O | X | X | X | X | | | |
| 82 | | | | | O | X | X | X | | | |
| 81X | | | | | O | X | X | X | | | |
| 80 | | | | | | | | | | | |
| | | | | Specimen #2 | | | | | | | |
| 130 | X | X | X | | | | | | | | |
| 120 | X | X | X | | | | | | | | |
| 110 | X | X | X | | | | | | | | |
| 100 | X | X | X | | | | | | | | |
| 95 | X | X | X | | | | | | | | |
| 90 | X | X | X | | | | | | | | |
| 85 | O | O | X | X | | | | | | | |
| 84 | | | X | X | X | | | | | | |
| 83 | | | X | X | X | X | | | | | |
| 82 | | | X | O | X | X | X | X | X | | |
| 81X | | | O | | X | O | O | O | O | | |
| 80 | | | | | O | | | | | | |
| | | | | Specimen #3 | | | | | | | |
| 130 | X | X | X | | | | | | | | |
| 120 | X | | | | | | | | | | |
| 110 | X | X | X | | | | | | | | |
| 100 | X | | | | | | | | | | |
| 95 | X | X | X | | | | | | | | |
| 90 | X | X | X | X | X | | | | | | |
| 85 | X | X | X | X | X | X | | | | | |
| 84 | O | O | X | X | X | X | | | | | |
| 82 | | | O | X | O | X | X | X | X | X | |
| 81 | | | | O | | X | X | X | X | X | |
| 80 | | | | | | O | O | X | X | X | |
| 79X | | | | | | | | O | O | O | |
| | | | | Specimen #4 | | | | | | | |
| 130 | X | X | | | | | | | | | |
| 120 | X | | | | | | | | | | |
| 110 | X | X | X | | | | | | | | |
| 100 | X | | | | | | | | | | |
| 95 | X | X | X | | | | | | | | |
| 90 | X | X | X | | | | | | | | |
| 85 | X | X | X | X | X | | | | | | |
| 84 | X | X | X | X | X | | | | | | |
| 83 | O | X | X | X | X | | | | | | |
| 82 | | O | O | X | X | X | X | X | | | |
| 81 | | | | O | O | X | X | X | | | |
| 80X | | | | | | O | O | O | | | |
| | | | | Specimen #5 | | | | | | | |
| 130 | X | | | | | | | | | | |
| 120 | X | X | | | | | | | | | |
| 110 | X | X | | | | | | | | | |
| 100 | X | X | | | | | | | | | |
| 90 | X | X | X | | | | | | | | |
| 85 | X | X | X | X | | | | | | | |
| 84 | X | X | X | X | X | | | | | | |
| 83 | X | X | X | X | X | X | | | | | |
| 82 | O | X | X | X | O | X | X | | | | |
| 81 | | O | O | O | | X | X | X | X | X | |
| 80 | | | | | O | X | X | X | X | | |
| 79X | | | | | | | O | O | O | O | |

On the basis of the experimental data, it is seen that the impulse value that can be withstood by the adhesive buckling strap diminishes as the adhesive buckling strap is impacted repeatedly. The final impulse value tends to be a fixed value. The following table contains the test data of the critical disengagement height (Δh) and the relative impulse (mv) of each adhesive buckling strap.

Considering the fact that the energy loss in a free-fall process of an object is not taken into consideration, and that the potential energy is completely transformed into the kinetic energy, the following formulas are obtained.

$$mgh = (1/2)mv^2$$
$$v = \sqrt{2}\ gh$$

Therefore, the impulse that is withstood by the adhesive buckling strap is mov=m√2 gΔh.

The mass of the balance weight used in the critical impulse experiment is 1 kg. As a result, the critical impulse of the sample 1 listed in Table 9 is:

$$mv = 1 \times \sqrt{2} \times 9.8 \times 0.17 = 1.83 \text{ kg. m/sec}$$

TABLE 9

38.1 × 20 mm adhesive buckling strap critical disengagement height and relative impulse

| specimen No. | critical disengagement height (cm) | critical impulse (Kg · m/sec) |
|---|---|---|
| 1 | 17 | 1.83 |
| 2 | 16 | 1.77 |
| 3 | 15 | 1.72 |
| 4 | 17 | 1.83 |
| 5 | 15 | 1.72 |

TABLE 10

25.4 × 20 mm adhesive buckling strap critical disengagement height and relative impulse

| specimen No. | critical disengagement height (cm) | critical impulse (Kg · m/sec) |
|---|---|---|
| 1 | 6 | 1.08 |
| 2 | 5 | 0.99 |
| 3 | 5 | 0.99 |
| 4 | 4 | 0.89 |
| 5 | 5 | 0.99 |

TABLE 11

38.1 × 16 mm adhesive buckling strap critical disengagement height and relative impulse

| specimen No. | critical disengagement height (cm) | critical impulse (Kg · m/sec) |
|---|---|---|
| 1 | 7 | 1.17 |
| 2 | 10 | 1.4 |
| 3 | 10 | 1.4 |
| 4 | 9 | 1.33 |
| 5 | 10 | 1.4 |

TABLE 12

25.4 × 16 mm adhesive buckling strap critical disengagement height and relative impulse

| specimen No. | critical disengagement height (cm) | critical impulse (Kg · m/sec) |
|---|---|---|
| 1 | 3 | 0.77 |
| 2 | 3 | 0.77 |
| 3 | 1 | 0.44 |
| 4 | 2 | 0.63 |
| 5 | 1 | 0.44 |

Figure 26:
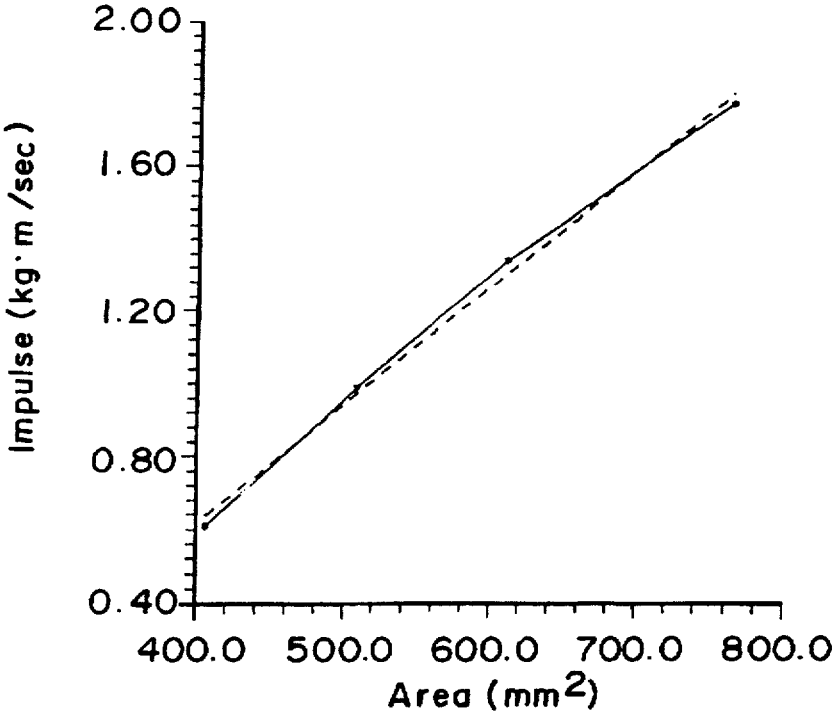
FIG. 26 is a diagram showing the relationship between the area of the adhesive buckling strap and the critical impulse. The critical impulse is shown in the longitudinal axis while the area is shown in the horizontal axis.

It is noted from the experimental data that the area of the adhesive buckling strap is in a direct proportion to the critical impulse. As shown in Table 9, the critical impulse of the 38.1 mm×20 mm adhesive buckling strap is in the range of 1.72~1.83 kg·m/sec. Table 10 shows that the 25.4 mm×20 mm adhesive buckling strap has a critical impulse ranging between 0.89 and 1.08 kg·m/sec. Table 11 shows that the 38.1 mm×16 mm adhesive buckling strap has a critical impulse ranging between 1.17~1.4 kg·m/sec. Table 12 shows that the 25.4 mm×16 mm adhesive buckling strap has a critical impulse ranging between 0.44~0.77 kg·m/sec. FIG. 26 illustrates the relationship between the average value of the critical impulses of four kinds of the adhesive buckling straps and the average area of four kinds of the adhesive buckling straps. In other words, a linear relationship exists between the impulse and the area of the adhesive buckling strap.

EXPERIMENT 7: Static Experiment of Adhesive Buckling Strap

The neck of a person wearing the safety helmet is vulnerable to a temporary impact or a slow pulling and dragging caused by the chin strap when the safety helmet falls toward the back of the person. The response of the adhesive buckling strap to a sudden impact was understood on the basis of the dynamic experiment described previously. This static experiment is intended to study the pulling force of the static disengagement of the adhesive buckling straps so as to enable us to have a better understanding of the characteristics of the adhesive buckling strap which is exerted on by a slow pulling and dragging force. The data of such a static experiment can be compared with those of the dynamic experiment.

Figure 27:
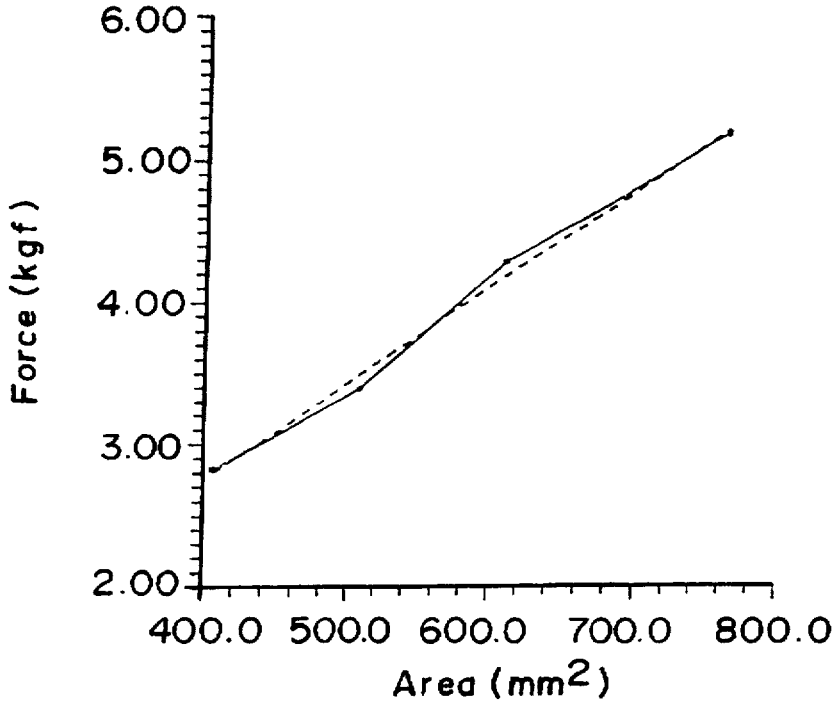
FIG. 27 show a diagram illustrating the relationship between the area of the adhesive buckling strap and the maximum static load. The force is shown in the longitudinal axis while the area is shown in the horizontal axis.
Figure 28:
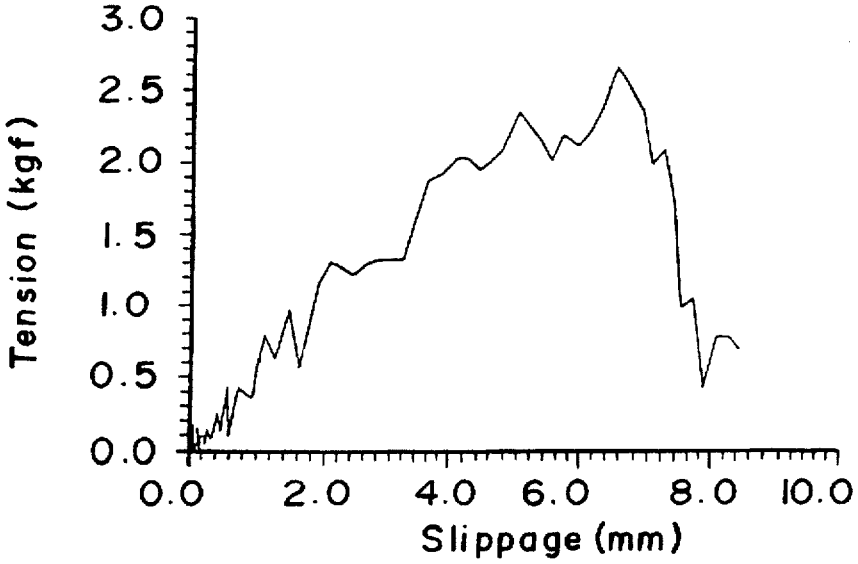
FIG. 28, 29, 30 and 31 are static test results of the adhesive buckling straps having different area sizes. The tension is shown in the longitudinal axis while the slippage is shown in the horizontal axis.
Figure 29:
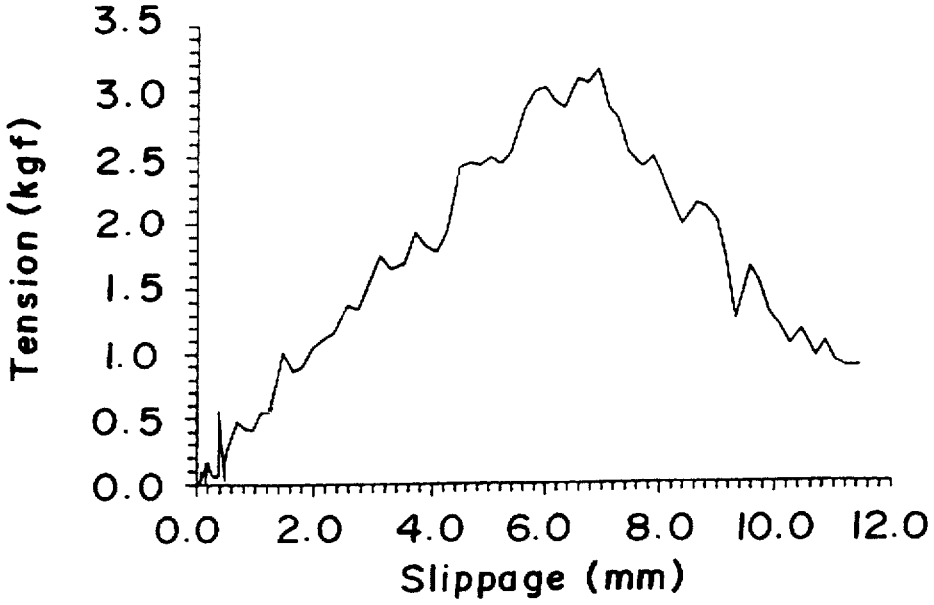
Figure 30:
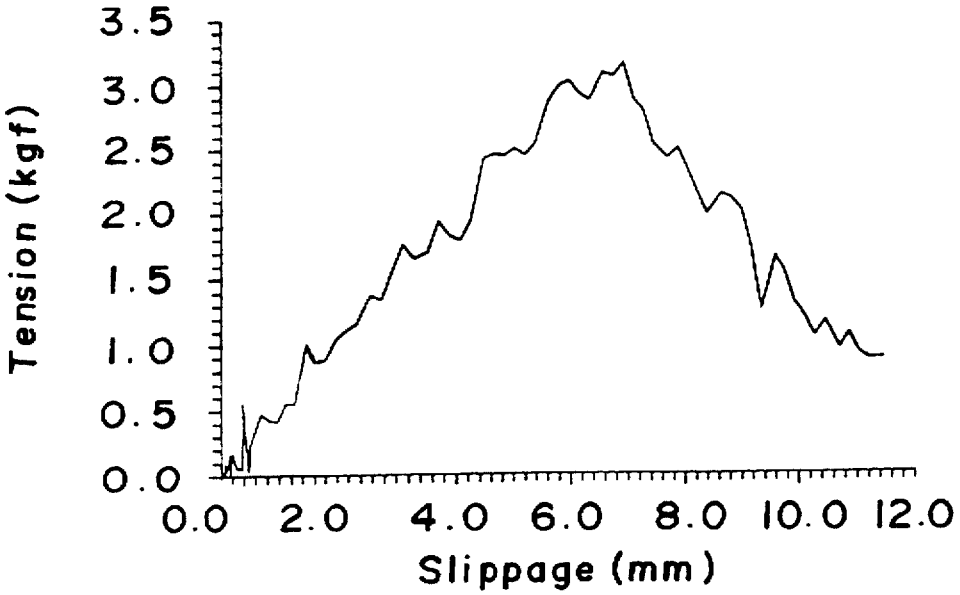
Figure 31:
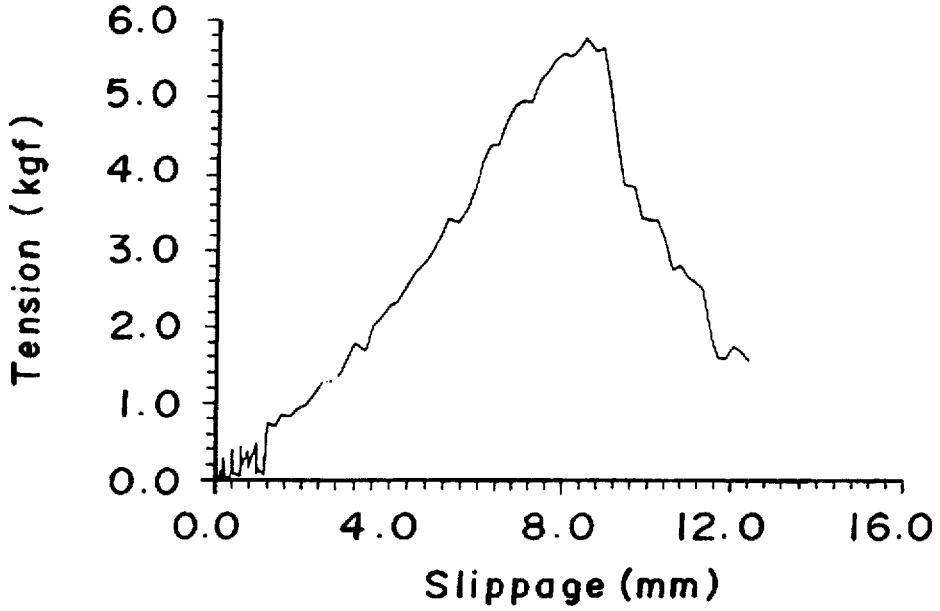

The test samples of the static experiment of the adhesive buckling strap are the same as those of the dynamic experiment. The machine used in the testing was the microcomputer universal material testing machine having a tensile speed of 10 mm/min. The test results of the static experiment on the adhesive buckling straps are presented in Table 13. The average values of the maximum disengagement static loads $P_{max}$ (unit: kgf) of the adhesive buckling straps having areas (unit: $mm^2$) of 25.4×16, 25.4×20, 38.1×16, and 38.1×20 are respectively 2.83, 3.39, 4.27, and 5.17. FIG. 27 shows the relationship between the average pulling force average value of the dynamic testing and the adhesive buckling strap area. FIGS. 28–31 show the relationships between the static test load of the adhesive buckling straps having four different areas, and the slippage of the adhesive buckling straps.

TABLE 13

STATIC TEST RESULTS OF ADHESIVE BUCKLING STRAPS

| Specimen ($mm^2$) | Test No. | $P_{max}$ (kgf) | Average (kgf) |
|---|---|---|---|
| 25.4 × 16 | 1 | 2.72 | 2.83 |
| | 2 | 2.51 | |
| | 3 | 3.02 | |
| | 4 | 3.03 | |
| | 5 | 2.87 | |
| 25.4 × 20 | 1 | 3.83 | 3.39 |
| | 2 | 3.27 | |
| | 3 | 3.29 | |
| | 4 | 3.23 | |
| | 5 | 3.34 | |
| 38.1 × 16 | 1 | 3.9 | 4.27 |
| | 2 | 4.23 | |
| | 3 | 4.87 | |
| | 4 | 4.25 | |
| | 5 | 4.08 | |
| 38.1 × 20 | 1 | 5.77 | 5.17 |
| | 2 | 4.28 | |
| | 3 | 4.82 | |
| | 4 | 6.3 | |
| | 5 | 4.67 | |

The fastening of a chin strap to the shell is attained by the fastening mechanisms located at both ends of the chin strap. The fastening mechanism of the chin strap of the present invention is of a hooked construction. The static and the dynamic impact experiments were done on the chin strap fastening mechanisms made of various materials and having various forms. The disengagement of severance critical impulse and the maximum static load of the chin strap fastening mechanisms are useful reference data for use in designing the strap fastening mechanisms.

EXPERIMENT 8: Critical Impulse Test on Chin Strap Fastening Mechanism

The experiment was intended to study the critical disengagement impulses of the chin strap fastening mechanisms made of the plastic #1 (white), the plastic #2 (white), the plastic #3 (black), the engineering plastic #1, the engineering plastic #2, and the engineering plastic #3. In general, a chin strap and the horizontal surface of the rim of a safety helmet shell, to which the chin strap is fastened, form an angle of 60 degrees. For this reason, a clamping tool with a fixed angle of 60 degrees was used in this experiment. The fastening lugs of the safety helmet were fastened with the clamping tool by means of bolts. The hook of the fastening mechanism of one end of the chin strap was engaged with the fastening hole of the lug of the safety helmet. Another end of the chin strap was fastened with a rope having a balance weight of 1 kgw fastened thereto. Throughout the testing, various changes in the impulse height were made so as to determine the height at which the disengagement of the fastening mechanism took place. Through a series of computations, the critical disengagement impulse that can be withstood by the fastening mechanism of the chip strap is as follows:

$$mv = m\sqrt{2}\ g\Delta h$$

TABLE 14

TEST RESULTS OF CHIN STRAP FASTENING MECHANISM*

| Test No. | Height (cm) | Disengagement (X)/ Engagement (O) |
|---|---|---|
| PLASTIC #1 SPECIMEN (WHITE) | | |
| 1 | 129 | X |
| 2 | 130 | X |
| 3 | 131 | X |
| 4 | 132 | X |
| 5 | 133 | X |
| 6 | 134 | O |
| 7 | 133 | X |
| 8 | 134 | O |
| 9 | 133 | X |
| 10 X | 134 | O |
| PLASTIC #2 SPECIMEN (WHITE) | | |
| 1 | 127 | X |
| 2 | 128 | X |
| 3 | 129 | X |
| 4 | 130 | X |
| 5 | 131 | X |
| 6 | 132 | O |
| 7 | 131 | X |
| 8 | 132 | O |
| 9 | 131 | X |
| 10 X | 132 | O |
| PLASTIC #3 SPECIMEN (BLACK) | | |
| 1 | 138 | O |
| 2 | 137 | O |
| 3 | 134 | O |
| 4 | 130 | O |
| 5 | 129 | X |
| 6 | 125 | O |
| 7 | 129 | X |
| 8 | 128 | O |
| 9 | 129 | X |
| 10 X | 128 | O |
| ENGINEERING PLASTIC #1 SPECIMEN | | |
| 1 | 146 | X |
| 2 | 147 | X |
| 3 | 148 | X |
| 4 | 149 | X |
| 5 | 150 | X |
| 6 | 151 | X |
| 7 | 152 | X |
| 8 X | 153 | O |
| ENGINEERING PLASTIC #2 SPECIMEN | | |
| 1 | 146 | X |
| 2 | 147 | X |
| 3 | 148 | X |
| 4 | 149 | X |
| 5 | 150 | X |
| 6 | 151 | X |
| 7 | 152 | X |
| 8 | 153 | X |
| 9 X | 154 | O |
| ENGINEERING PLASTIC #3 SPECIMEN | | |
| 1 | 146 | X |
| 2 | 147 | X |
| 3 | 148 | X |
| 4 | 149 | X |
| 5 | 150 | X |
| 6 | 151 | X |
| 7 | 152 | X |
| 8 | 153 | X |
| 9 X | 154 | O |

*The basis height of the specimens of plastic #1 (white) and plastic #2 (white) is 122 cm; and the basis height of the specimens of plastic #3 (black), engineering plastic #1, 2 and 3 is 121 cm.
X Critical disengagement height.

TABLE 15

CRITICAL DISENGAGEMENT HEIGHT (Δh) AND RELATIVE IMPULSE (mv) OF FASTENING MECHANISMS MADE OF VARIOUS MATERIALS

| Specimen | Critical disengagement height (cm) | Critical impulse (Kg · m/sec) |
|---|---|---|
| plastic #1 (white) | 12 | 1.4 |
| plastic #2 (white) | 10 | 1.53 |
| plastic #3 (black) | 7 | 1.25 |
| engineering plastic #1 | 32 | 2.5 |
| engineering plastic #2 | 33 | 2.54 |
| engineering plastic #3 | 33 | 2.54 |

The experimental results show that the hook of the fastening mechanism is caused to deform elastically to become disengaged when the fastening mechanisms made of the plastic #1 (white) and the plastic #2 (white) are exerted on by an impulse ranging between 1.4~1.53 kg·m/sec. The fastening mechanism made of the plastic #3 (black) was disengaged after the fastening mechanism was caused to bear an impulse of 1.25 kg·m/sec. The fastening mechanisms made of the engineering plastic #1, #2, and #3 were caused to disengaged by the severance of hooks after the fastening mechanisms were acted on by an impulse ranging between 2.50~2.54 kg·m/sec.

EXPERIMENT 9: STATIC TEST OF CHIN STRAP FASTENING MECHANISM

Figure 32:
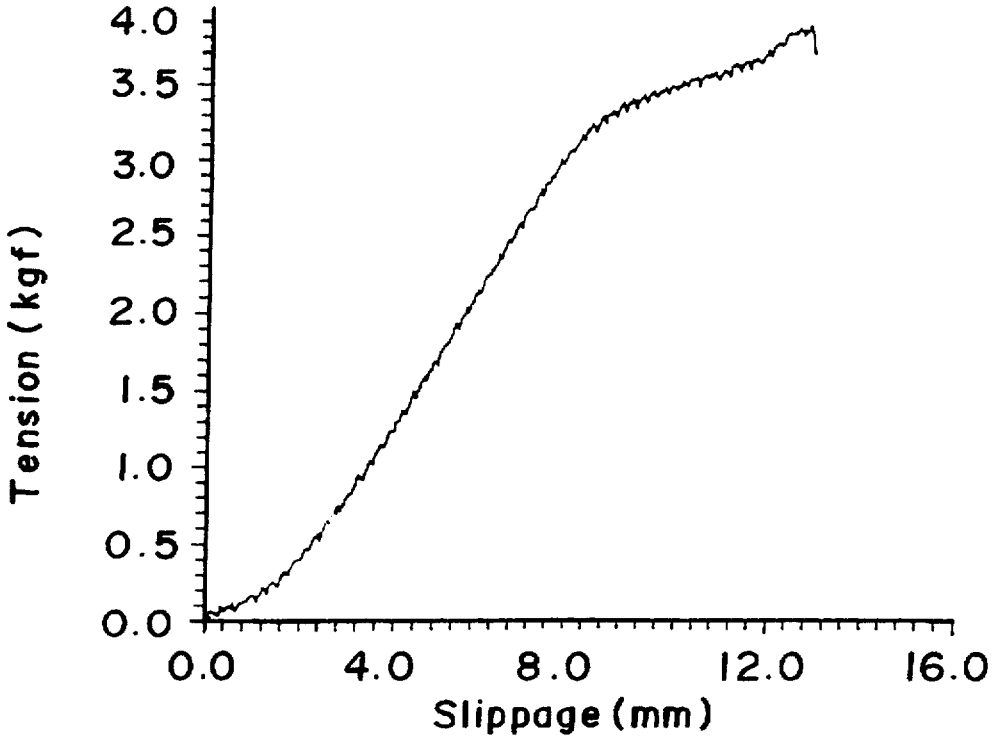
FIG. 32 is a diagram showing the test result of the chin strap. The tension is shown in the longitudinal axis while the slippage is shown in the horizontal axis.

On the basis of the dynamic test results described previously, it is suggested that the chin strap fastening mechanism of an elastic material is more suitable for use in making up of an automatic disengagement device. In order to have a further understanding of the effect of a slow pulling and dragging force, this experiment was carried out by using a universal material testing machine for testing the chin strap fastening mechanisms made of four plastic materials (white). The experiment was intended to study the maximum static load and the disengagement phenomena of the factors causing the fastening mechanisms to become disengaged. Table 16 contains the results of the maximum static load of the fastening mechanism of the plastic (white) material. K·(kgf/mm) is an expression of the strength of the fastening mechanism. $P_{max}$ is an expression of the maximum static load. FIG. 32 shows an example to account for the conditions under which the fastening mechanism is exerted on by the force when the static experiment is in progress. The plastic fastening mechanism is made of a resilient material and is therefore vulnerable to a tensile oscillation (the small peaks of the curve in FIG. 32) when the fastening mechanism is acted on by a tensile.

TABLE 16

STATIC TEST RESULTS OF PLASTIC FASTENING MECHANISMS (WHITE)

| Specimen | K (Kgf/mm) | $P_{max}$ (kgf) | Average (kgf) |
|---|---|---|---|
| 1 | 0.48 | 3.88 | K = 0.4269124 |
| | 0.44 | 3.64 | (Kgf/mm) |
| | 0.41 | 3.55 | P = 3.6225 |
| | 0.41 | 3.53 | (kgf) |
| | 0.396127 | 3.53 | |
| 2 | 0.46 | 3.79 | K = 0.4269766 |

TABLE 16-continued

STATIC TEST RESULTS OF PLASTIC FASTENING MECHANISMS (WHITE)

| Specimen | K (Kgf/mm) | $P_{max}$ (kgf) | Average (kgf) |
|---|---|---|---|
| | 0.44 | 3.61 | (Kgf/mm) |
| | 0.42 | 3.6 | P = 3.59 |
| | 0.41 | 3.49 | (kgf) |
| | 0.4 | 3.46 | |
| 3 | 0.42 | 4.25 | K = 0.380238 |
| | 0.38 | 4.05 | (Kgf/mm) |
| | 0.37 | 4.04 | P = 4.045 |
| | 0.37 | 3.96 | (kgf) |
| | 0.36 | 3.93 | |
| 4 | 0.44 | 3.8 | K = 0.4023544 |
| | 0.41 | 3.66 | (Kgf/mm) |
| | 0.4 | 3.59 | P = 3.5775 |
| | 0.4 | 3.59 | (kgf) |
| | 0.36 | 3.25 | |

By comparing the results of the dynamic test and the static test, it is known that the maximum static load of the static test results ranges between 3.57 and 4.045, about twice greater than the dynamic test results ranging between 1.4 and 1.53. These results are in conformity with the results of the general static test and the general dynamic test.

What is claimed is:

1. An industrial safety helmet having a front, a rear, opposite lateral sides, a rim, a longitudinal axis extending between the front and the rear, and a transverse axis extending between opposite lateral sides, the helmet comprising a hollow rigid shell having a substantially semi-ovoid configuration, the shell having: a top portion with a primary flexure extending upwardly from the top portion along a direction substantially parallel to the longitudinal axis, the primary flexure having a front end opening and a rear end opening to thereby form an air passage enabling air circulation within the shell; and a secondary flexure extending outwardly from each opposite lateral side in a direction substantially parallel to the transverse axis, each secondary flexure having a lateral ventilation port and an end contiguous with the rim of the shell.

2. The industrial safety helmet as defined in claim 1, wherein said shell further comprises a recess located in front of said front end opening of said primary flexure.

3. The industrial safety helmet as defined in claim 1, wherein said shell further comprises a third flexure located in front of said front end opening of said primary flexure, said third flexure further having one end which is of said front end opening of said primary flexure, the one end having a front ventilation port.

4. The industrial safety helmet as defined in claim 1, wherein said shell further comprises a shock-absorbing cradle fastened thereto, said cradle comprising at least two suspension straps and one ring-shaped head strap, with ends of said suspension straps being fastened respectively with two opposite sides of said head strap such that said suspension straps intersect with each other, said suspension straps having one end which is contiguous to said head strap and fastened in an interior adjacent to said rim of said shell, said suspension straps having at least one folding fastened thereto by sewing, said folding capable of absorbing energy when said suspension straps are stretched by a predetermined tension.

5. The industrial safety helmet as defined in claim 4, further comprising an elastic pad connected to said suspension straps at the intersection thereof.

6. The industrial safety helmet as defined in claim 1 further comprising a chin strap having ends fastened to said rim, said chin strap provided between said ends with a detachable adhesive buckling mechanism.

7. The industrial safety helmet as defined in claim 6, wherein said rim of said shell is provided with two fastening holes, one hole located in each of the opposite lateral sides and further comprising hooks provided at said ends of said chin strap and engaging the fastening holes.

* * * * *